US009679429B2

(12) United States Patent
Duncan et al.

(10) Patent No.: US 9,679,429 B2
(45) Date of Patent: Jun. 13, 2017

(54) WIRELESS PORTABLE LOCK SYSTEM

(71) Applicant: 13876 Yukon Inc., Whitehorse (CA)

(72) Inventors: Gordon Andrew Duncan, Whitehorse (CA); Alexander Jeffrey Feldman, Vancouver (CA); Alexander John Stone, Burnaby (CA)

(73) Assignee: 13876 Yukon Inc., Whitehorse, CA (US)

( * ) Notice: Subject to any disclaimer, the term of this patent is extended or adjusted under 35 U.S.C. 154(b) by 502 days.

(21) Appl. No.: 14/093,357

(22) Filed: Nov. 29, 2013

(65) Prior Publication Data

US 2014/0150502 A1 Jun. 5, 2014

Related U.S. Application Data

(60) Provisional application No. 61/863,292, filed on Aug. 7, 2013, provisional application No. 61/732,499, filed on Dec. 3, 2012.

(51) Int. Cl.
*E05B 47/06* (2006.01)
*G07C 9/00* (2006.01)
(Continued)

(52) U.S. Cl.
CPC ..... *G07C 9/00309* (2013.01); *E05B 47/0004* (2013.01); *E05B 47/0012* (2013.01); *E05B 67/10* (2013.01); *E05B 67/14* (2013.01); *G07C 9/00944* (2013.01); *E05B 2047/0058* (2013.01); *E05B 2047/0094* (2013.01);
(Continued)

(58) Field of Classification Search
CPC ..... G07C 9/00309; G07C 9/00944; G07C 9/00563; G07C 9/00182; G07C 2009/00634; E05B 47/0012; E05B 47/0004; E05B 67/10; E05B 67/14; E05B 2047/0094; E05B 2047/0058; E05B 2047/0095; E05B 47/0607; Y10T 70/413; Y10T 70/7102
USPC ... 70/257, 35–37, 27–29, 41–47, 14–20, 23, 70/24, 277, 278.7, 279.1, 282, 283, 278.1
See application file for complete search history.

(56) References Cited

U.S. PATENT DOCUMENTS 1,193,679 A * 8/1916 Fox ..... B60R 25/005 70/199
3,543,547 A * 12/1970 Sugiyama ..... E05B 47/0047 292/201
(Continued)

FOREIGN PATENT DOCUMENTS

DE 10056119 B4 6/2002
EP 2607582 A2 6/2013
(Continued)

OTHER PUBLICATIONS www.brit.co/bitlock/, Oct. 28, 2013.

*Primary Examiner* — Lloyd Gall
(74) *Attorney, Agent, or Firm* — Oyen Wiggs Green & Mutala LLP

(57) ABSTRACT

A portable lock includes a wireless signal receiver. The lock may be unlocked by transmitting a wireless unlock signal from a portable device such as a cellular telephone. Various actuation mechanisms which may include a solenoid, motor or memory wire of a type that contracts when energized are provided in example embodiments. Self-locking embodiments are readily operated with one hand.

15 Claims, 27 Drawing Sheets

(51) Int. Cl.
*E05B 67/14* (2006.01)
*E05B 47/00* (2006.01)
*E05B 67/10* (2006.01)

(52) U.S. Cl.
CPC .. *E05B 2047/0095* (2013.01); *G07C 9/00563* (2013.01); *G07C 2009/00634* (2013.01); *Y10T 70/413* (2015.04); *Y10T 70/7102* (2015.04)

(56) References Cited

U.S. PATENT DOCUMENTS 3,901,057 A * 8/1975 Coley, Sr. ..... E05B 47/00 70/20
4,747,280 A * 5/1988 Shaw ..... E05B 47/0002 211/64
4,949,559 A * 8/1990 Glines ..... B60R 7/14 211/64
4,972,784 A * 11/1990 Ing-Hsiang ..... E05B 75/00 109/24.1
5,197,309 A * 3/1993 Del Rosario ..... B60R 25/0221 70/209
6,300,873 B1 * 10/2001 Kucharczyk ..... A47G 29/141 235/382.5
6,574,798 B1 * 6/2003 Bradley ..... H04N 7/165 340/4.37
6,761,051 B1 * 7/2004 Tsai ..... E05B 47/0012 70/257
6,989,732 B2 * 1/2006 Fisher ..... G07C 9/00103 109/45
7,021,092 B2 4/2006 Loughlin et al.
7,047,771 B2 * 5/2006 Tanos ..... E05B 15/0046 211/64
7,334,443 B2 2/2008 Meekma et al.
7,382,250 B2 6/2008 Marcelle et al.
7,423,515 B1 * 9/2008 Fiske ..... E05B 47/0002 340/5.2
7,948,359 B2 5/2011 Marcelle et al.
8,225,629 B2 7/2012 Zuraski et al.
8,274,365 B2 9/2012 Piccirillo et al.
8,453,481 B2 6/2013 Meekma
8,585,345 B2 11/2013 Sikorski et al.
8,991,224 B2 * 3/2015 Zalavari ..... A47B 81/00 206/317
9,151,082 B2 * 10/2015 Zalavari ..... E05B 73/00
2005/0039499 A1 * 2/2005 Didomenico ..... B60R 99/00 70/16
2005/0099262 A1 5/2005 Childress et al.
2006/0164208 A1 7/2006 Schaffzin et al.
2006/0179903 A1 * 8/2006 Goldman ..... E05B 47/0002 70/278.7
2007/0289342 A1 * 12/2007 Brooks ..... E05B 47/0002 70/16
2007/0290789 A1 12/2007 Segev et al.
2008/0290990 A1 11/2008 Schaffzin et al.
2009/0256676 A1 10/2009 Piccirillo et al.
2009/0282876 A1 * 11/2009 Zuraski ..... E05B 67/003 70/35
2009/0320537 A1 12/2009 Alexander
2010/0089108 A1 4/2010 Dutt et al.
2010/0206017 A1 * 8/2010 Garibaldi ..... E05B 75/00 70/16
2011/0050419 A1 3/2011 Ng et al.
2012/0011902 A1 1/2012 Meekma
2012/0154115 A1 * 6/2012 Herrala ..... G07C 9/00111 340/5.64
2013/0036781 A1 2/2013 Hartmann et al.
2013/0255335 A1 10/2013 Jonely
2014/0077929 A1 * 3/2014 Dumas ..... G07C 9/00571 340/5.61

FOREIGN PATENT DOCUMENTS

GB 2491340 A 5/2012
JP 2006-104696 A 4/2006
JP 2013-534580 A 9/2013
WO 0061897 A1 10/2000
WO 2006026758 A2 3/2006
WO 2011112139 A1 9/2011
WO 2012042515 A1 4/2012
WO 2012047850 A2 4/2012
WO 2013078561 A1 6/2013
WO 2013148274 A1 10/2013

* cited by examiner

WIRELESS PORTABLE LOCK SYSTEM

RELATED APPLICATIONS

This application claims the benefit under 35 U.S.C. §119 of U.S. Application No. 61/863,292 filed 7 Aug. 2013 and U.S. Application No. 61/732,499 filed 3 Dec. 2012, both entitled WIRELESS SELF-CLOSING PORTABLE LOCK SYSTEM and which are both hereby incorporated herein by reference for all purposes.

TECHNICAL FIELD

This invention relates to a novel device in the general field of portable locks, and more specifically to locks having locking mechanisms actuated by means of wireless signal(s). The signals may be sent from a portable device such as a smartphone or similar device. Some embodiments provide self-closing locks.

BACKGROUND

Portable locks are convenient in that they can be interchangeably used to secure a portable item to a stationary or immovable object to prevent its removal, or to secure lockers by means of a hasp or entryway doors or fences by employing a chain. Some of the earliest portable locks were padlocks designed with an inverted U-shaped shackle which opened at the turn of a physical key. Locks employing U-shaped shackles are often inconvenient to attach with one hand, and can sometimes appear to be locked even when the shackle is not fully engaged, rendering the lock useless in practice.

Most mechanical locks can be picked at the keyway, or their physical keys copied. It is often cheaper to buy a new padlock than to re-key one if old keys have not been returned. Neither of these circumstances ensures practical security. Other problems with mechanical keyed locks include keyways that expose the insides of the lock to tampering or damage, and keys can only be made in a very limited number of physical combinations compared to commonly available encryption options. The use of combination locks limit physical access to the lock interior, but are still deficient with their severely limited number of combinatorial options, which are susceptible to cracking with patient application. These deficiencies increase the likelihood that a generic portable lock will be compromised by physical or mathematical means.

A recently employed method of remotely opening portable locks is the use of radio transceivers which activate the lock mechanism directly or by means of a motor. Remote electronic communication employing transceivers inside locks enable the user to open a lock by infrared (U.S. Pat. No. 7,948,359), by use of dedicated key-fobs (U.S. Pat. No. 7,382,250), or by combining a physical key with an attached transceiver element (U.S. Pat. No. 7,334,443). These solutions still require the user to carry a secondary physical key or fob in order to open each lock.

Some electronic locks use an RF activated motor to physically open the shackle of the lock, but this method requires an inefficient amount of power for a device that needs to operate reliably (U.S. Pat. No. 8,225,629, U.S. Pat. No. 7,948,359).

There remains a need for locks that are convenient and trustworthy to use. The lock design should ideally prevent ready access to the lock interior; allow the user to operate the lock reliably with the minimum of power for securement, and secure or open the lock by an encrypted wireless signal that is generated by a common device that is already carried by most users, e.g., a wireless smart phone or similar device. The following disclosure will provide detailed explanations and drawings of the various yet related solutions to the above outlined deficiencies in the prior art.

SUMMARY

The invention has a number of aspects. One aspect provides wirelessly-controlled locks. An example embodiment provides a wireless self-closing portable lock system which allows a user to conveniently and securely operate one or more locks by means of a smart phone or similar wireless device. Two example representative and compatible lock designs are disclosed, each employing a signal receiver such as a Bluetooth™ receiver, one actuated by a solenoid or a motor, the other by electrically energizing memory wire(s), both releasing the lock shackle or gate when the correct signal is sent from a wireless device.

Some of the advantages of the keyless portable lock system include but are not limited to: fewer insecure openings into the lock interior; easier to attach & secure with self-closing shackles or gate arms; the ability to unlatch one or more locks remotely by means of a common wireless device; much less likelihood of cracking a lock's combination due to the ability to use very long and complex pass-codes; the ability to instantly "re-key" the wireless pass-code if it is compromised; the convenience of using a smartphone to configure multiple methods of lock access such as biometric, audio, combination, or simply lock/unlock buttons once a phone has been unlocked to the user.

Further aspects and example embodiments are illustrated in the accompanying drawings and/or described in the following description.

BRIEF DESCRIPTION OF THE DRAWINGS

The accompanying drawings illustrate non-limiting example embodiments of the invention.

FIG. 4*a* is a side cutaway view of a Pivot Lock, while

FIG. 5*a* is a side isometric view of the basic latching-locking mechanism of the Pivot Lock, while

FIG. 7*a* is a front view of the Clip Lock in its Open configuration, while

FIG. 13*a* is an isometric overview of Locking Battery & Carrier Covers assembly, while

FIG. 14*a* is an isometric overview of Locking Battery & Carrier Covers insertion, while

FIG. 15*a* is an isometric detailed view of Locking Battery Cover installation in the Carrier (PLM), while

FIG. 17*c* is an isometric view of the PLM with an emergency jumpstart battery about to be inserted into the receiver, while

Figure 1A:
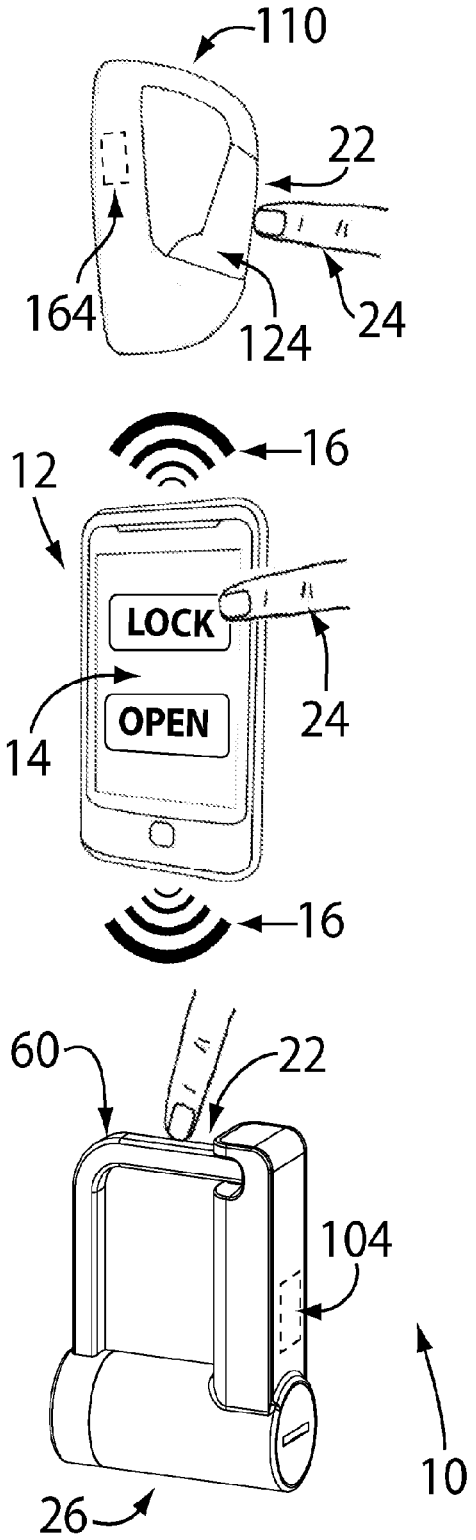
FIG. 1*a* is an overview of an example Portable Wireless Self-Closing Lock System showing the user remotely locking two self-closing locks by means of a wireless device.

| | |
|---|---|
| 10 | Portable Lock System |
| 12 | Wireless Device |
| 14 | Lock Software GUI |
| 16 | Wireless Signal |
| 18 | Opened |
| 20 | Latched |
| 22 | Locked |
| 24 | User Input |
| 26 | PIVOT LOCK (PL) |
| 28 | Housing (PL) |
| 30 | Pivot Drum |
| 32 | Shackle Cap |
| 34 | Carrier Cover |
| 36 | Battery Cover |
| 37 | Striker Spring Cup |
| 38 | Shackle Inlet |
| 40 | Pin Outlet |
| 42 | Carrier (PL) |
| 43 | Carrier Bay |
| 44 | Battery Well |
| 45 | Block Guide |
| 46 | Mechanism (PL) |
| 48 | Striker Plate |
| 50 | Latch Pin |
| 52 | Striker Spring |

-continued

| | |
|---|---|
| 54 | Spring Trap |
| 56 | Guide Bolt |
| 57 | Travel Guide |
| 58 | Guide Slot |
| 60 | Shackle |
| 62 | Pin Divot |
| 64 | Shackle Tang |
| 66 | Tang Entry |
| 68 | Tang Securement |
| 70 | Actuator (PL) |
| 72 | Locking Block |
| 73 | Block Fastener |
| 74 | Plunger |
| 76 | Solenoid |
| 78 | Plunger Spring |
| 80 | Pivot Spring Lock Plate |
| 82 | Pivot Spring |
| 84 | Pivot Spring Hook |
| 86 | Pivot Spring End |
| 88 | Pivot Spring Hole |
| 89 | Pivot Spring Slot |
| 90 | Shackle Cap Plate |
| 92 | Plate Washer |
| 94 | Washer Well |
| 96 | Tang Bolt |
| 100 | Electronics (PL) |
| 102 | Main Circuit Board |
| 104 | PL Receiver |
| 106 | Drive Circuit Board |
| 108 | Battery |
| 110 | CLIP LOCK (CL) |
| 112 | Housing (CL) |
| 114 | Hook |
| 116 | Front Cover |
| 118 | Rear Cover |
| 120 | Carrier (CL) |
| 122 | Mechanism (CL) |
| 124 | Gate |
| 126 | Gate Wheel |
| 128 | Gate Interlock |
| 130 | Hook Interlock |
| 132 | Gate Spring |
| 133 | Gate Spring Slot |
| 134 | Wheel Post |
| 136 | Actuator (CL) |
| 138 | Pawl Wire |
| 139 | Catch Wire |
| 140 | Ring Term. Crimp Fast. Assy. |
| 142 | Top Pawl Pulley |
| 144 | Catch Pulley |
| 146 | Bottom Pawl Pulley |
| 148 | Pawl |
| 150 | Pawl Post |
| 152 | Pawl Spring |
| 154 | Catch |
| 156 | Catch Spring |
| 158 | Catch Spring Holder |
| 160 | Electronics (CL) |
| 162 | Main PCB |
| 164 | CL Receiver |
| 166 | Switch Board |
| 168 | Battery |
| 170 | Battery Clip |
| 172 | Capacitor |
| 174 | |
| 180 | PIVOT LOCK (PLM) |
| — | Housing (PLM) |
| 184 | Carrier (PLM) |
| 186 | Locking Carrier Cover |
| 188 | Tab Eyelet |
| 190 | Lightpipe Porthole |
| 192 | Carrier Cover Clip |
| 194 | Locking Battery Cover |
| — | — |
| 198 | Locking Tab |
| 200 | Tab Stay Hook |
| 202 | Battery Cover Hook |
| 204 | Cover Hook Receiver |
| — | Mechanism (PLM) |

-continued

| | |
|---|---|
| 208 | Striker Plate (PLM) |
| 210 | Tab Slot |
| 212 | Tab Stay |
| 214 | Pinion |
| 216 | Top Rack |
| 218 | Bottom Rack |
| 220 | Rack Stop |
| 222 | Stop Receiver |
| — | Actuator (PLM) |
| 226 | Motor |
| 228 | Reduction Gear |
| 230 | Output Shaft |
| 232 | Motor Restraint |
| 234 | Gear-motor Fastener |
| — | Electronics (PLM) |
| 238 | Contact Pad (−) |
| 240 | Isolation Ring |
| 242 | Contact Ring (+) |
| 244 | Conical Spring |
| 246 | Ganged Negative Plates (−) |
| 248 | Positive Plate (+) |
| 250 | Status LED |
| 252 | Status LED Lightpipe |
| 254 | External Battery Receiver |
| 256 | Wire to Bluetooth |

DESCRIPTION

Throughout the following description specific details are set forth in order to provide a more thorough understanding to persons skilled in the art. However, well known elements may not have been shown or described in detail to avoid unnecessarily obscuring the disclosure. The following description of examples of the technology is not intended to be exhaustive or to limit the system to the precise forms of any example embodiment. Accordingly, the description and drawings are to be regarded in an illustrative, rather than a restrictive, sense.

Because there are multiple ways to design self-closing lock housings, two compatible representative implementations are discussed in detail herein, namely an example pivot lock implementation and an example clip lock implementation. Elements that are similar, compatible, or logically equivalent to both implementations have been grouped into the following categories: namely Housing, Mechanism, Actuator and Electronics.

Figure 1B:
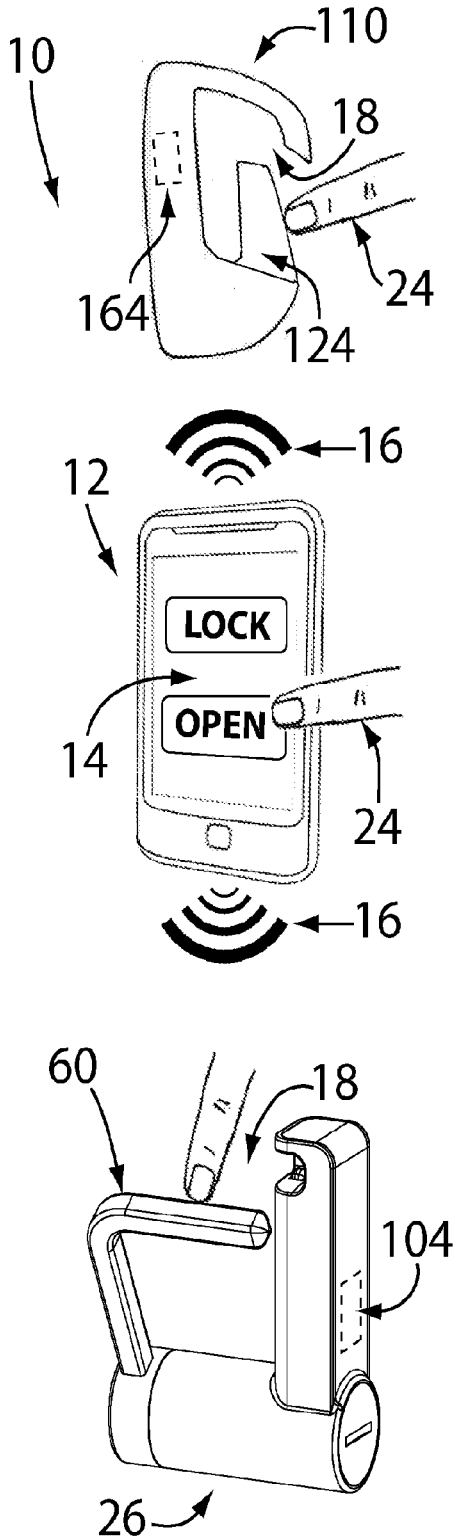
FIG. 1*b* shows the user opening both locks by the same means.

FIG. 1*a* is an overview of an example Wireless Self-Closing Portable Lock System 10 showing a user input 24 to the lock software graphical user interface (G.U.I.) 14 of a wireless device 12 generating a wireless signal 16 to a PL receiver 104 (Bluetooth) in the pivot lock 26 and the CL receiver 164 (Bluetooth) in the clip lock 110. Internal electronics actuate a locking mechanism (46 or 122) which locks 22 the gate 124 of the clip lock 110, and the shackle 60 of the pivot lock 26. FIG. 1*b* shows the user 24 opening 18 both locks by the same means as in FIG. 1*a*. Note that the disclosed locks can be in only one of three possible states, namely Locked, Latched (unlocked, but unopened), or Opened (i.e., the open position of the unlocked shackle or gate arm).

Pivot Lock (Solenoid Actuated) Elements

Figure 2A:
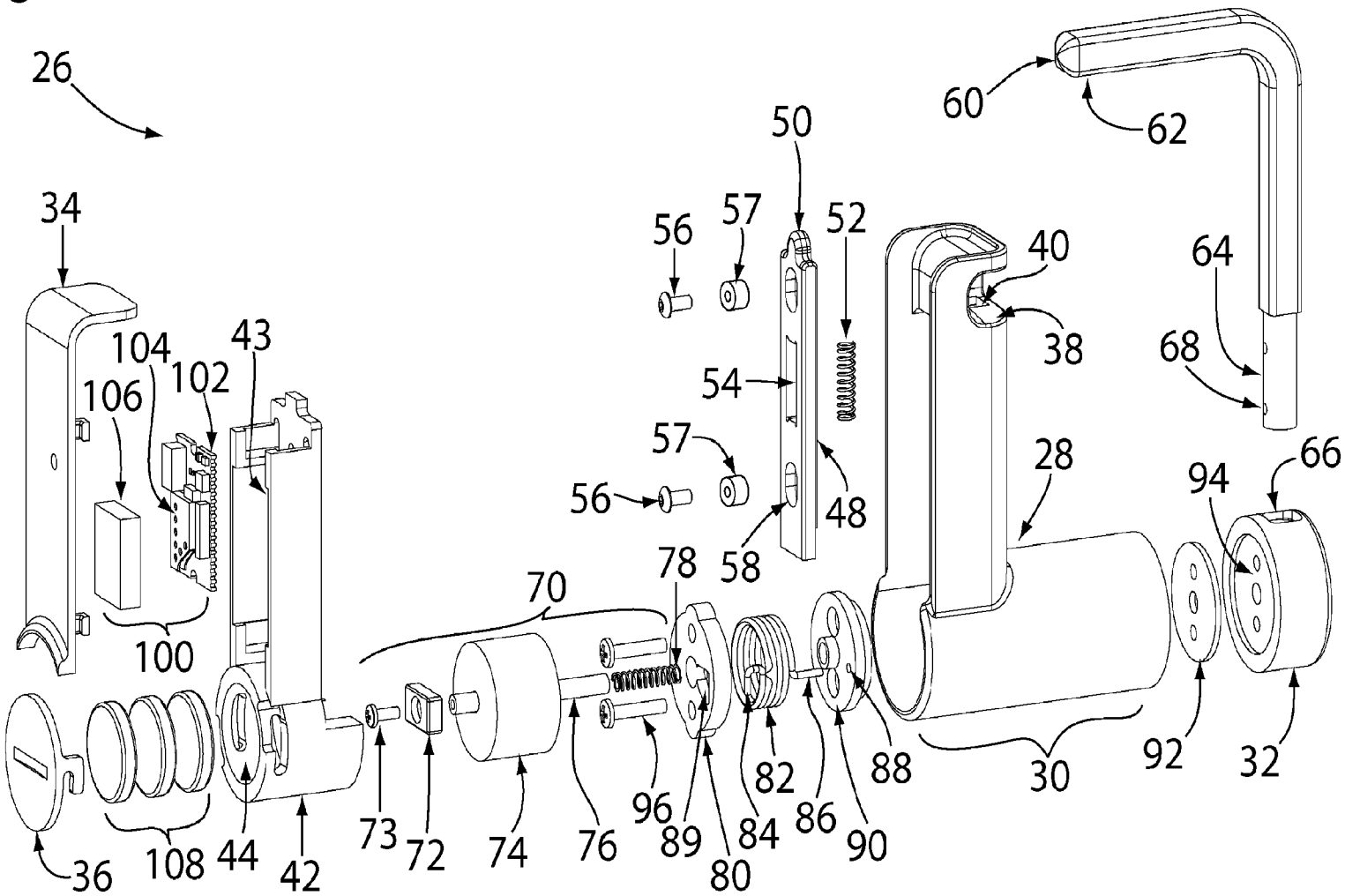
FIG. 2*a* is a side isometric exploded view of a Pivot Lock implementation of the Self-Closing Lock System.

FIG. 2*a* is a side isometric exploded view of the Pivot Lock 26 implementation of the Portable Lock System 10. Related elements will be discussed separately as Housing, Mechanism, Actuator and Electronics. FIGS. 2*a* through 5*b* show elements for a solenoid actuated implementation of the pivot lock 26. An alternative implementation of the pivot lock 26 which employs a motor to actuate the lock mechanism, is shown in FIGS. 9*a* through 18*b*. This alternative configuration also shows improved battery & electronics bay securement and a means to jumpstart a discharged battery. These additional features may also be used in other embodiments. The function and operation of additional or modified elements that may be provided in this implementation are explained in detail in the Pivot Lock (Motor Actuated) Implementation section below.

The housing 28 and its contiguous pivot drum 30 enclose all device elements except the shackle 60 and its shackle cap 32. Most elements of the pivot lock 26 are installed into, or are secured by the carrier 42 which inserts into the housing as shown in FIG. 2*a*. The carrier bay 43 is enclosed by a carrier cover 34, while the battery well is enclosed by a battery cover 36.

The actuator 70 employs a solenoid 74 with a plunger 76 which can be retracted against the force of the plunger spring 78, by electrically energizing solenoid 74. A locking block 72, affixed by a fastener 73 to the end of the plunger 76, is extended towards the carrier 42 and is used to block downward movement of the striker plate 48, and its latch pin 50.

The (locking/latching) mechanism 46 includes a striker plate 48, pivot spring 82, and shackle 60 elements. The striker plate 48 includes a latch pin 50, spring 52, spring trap 54, and guide slots 58. Cylindrical travel guides 57 are secured by guide bolts 56 to the carrier 42 face, which also supports a striker spring cup 37. The pivot spring 82 is secured between a lock plate 80 and a shackle cap plate 90, whereby the spring's 82 hook 84 fits into the slot 89 of the lock plate 80, and its end 86 inserts into the hole 88 in the cap plate 90. This pivot spring assembly is secured by tang bolts 96 into threaded holes 68 in the tang 64 of the shackle 60 through corresponding holes in a delrin plate washer 92 and a washer well 94 in the shackle cap 32 as shown. When assembled, the latch pin 50 protrudes from the pin outlet 40 in the base of the shackle inlet 38 and into the pin divot 62 in the underside of the shackle 60. (see FIG. 5*b*)

Electronics 100, namely a main PCB 102 with PL receiver 104, and a drive PCB 106, are secured by a cover 34 into the bay 43 of a carrier 42. Batteries 108 are secured in their well 44 in the bottom of the carrier 42 by means of a cover 36.

Figure 2B:
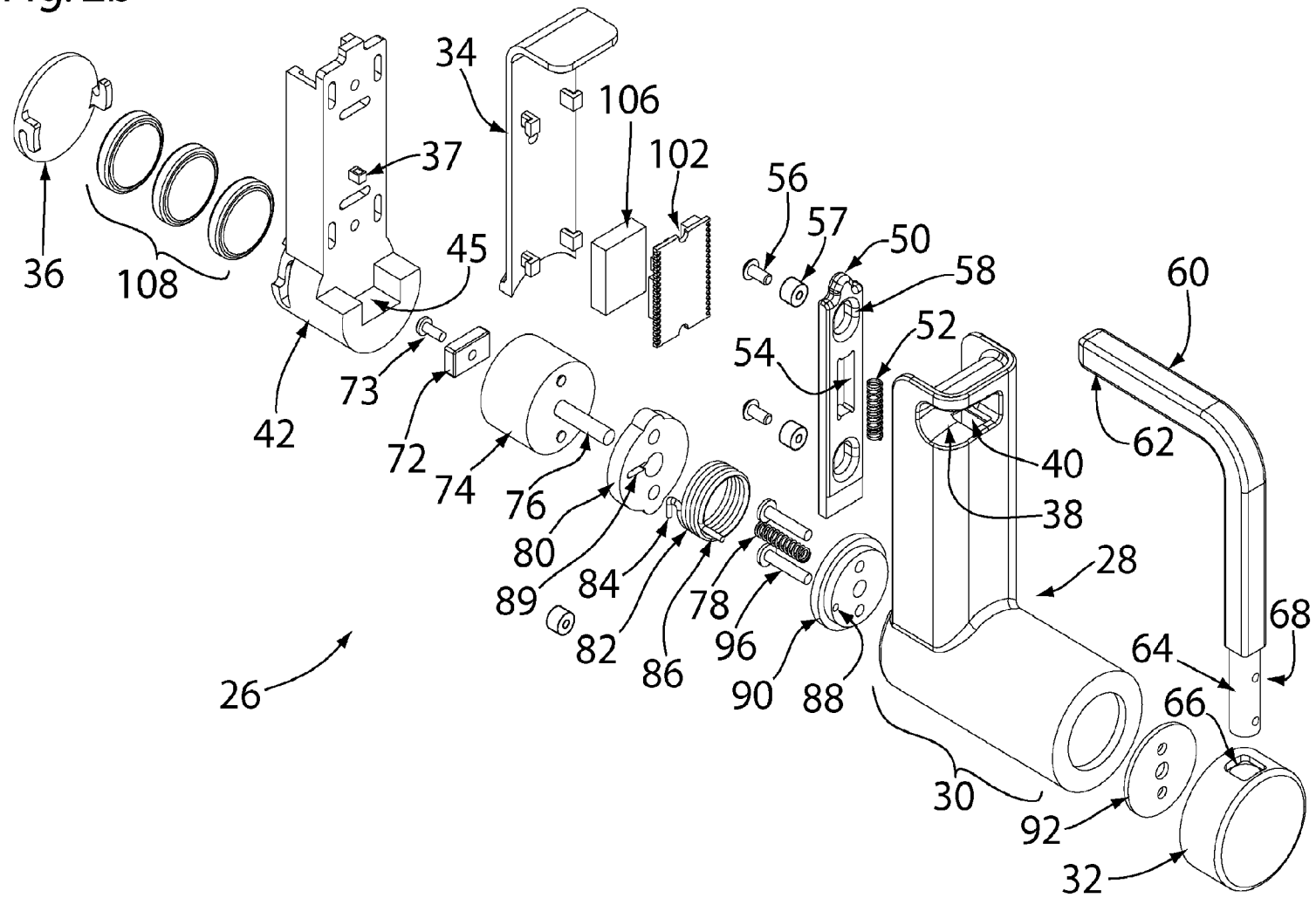
FIG. 2*b* shows a top isometric exploded view of the Pivot Lock implementation.

FIG. 2*b* shows a top isometric exploded view of the pivot lock 26 as described for FIG. 2*a* above.

Figure 3A:
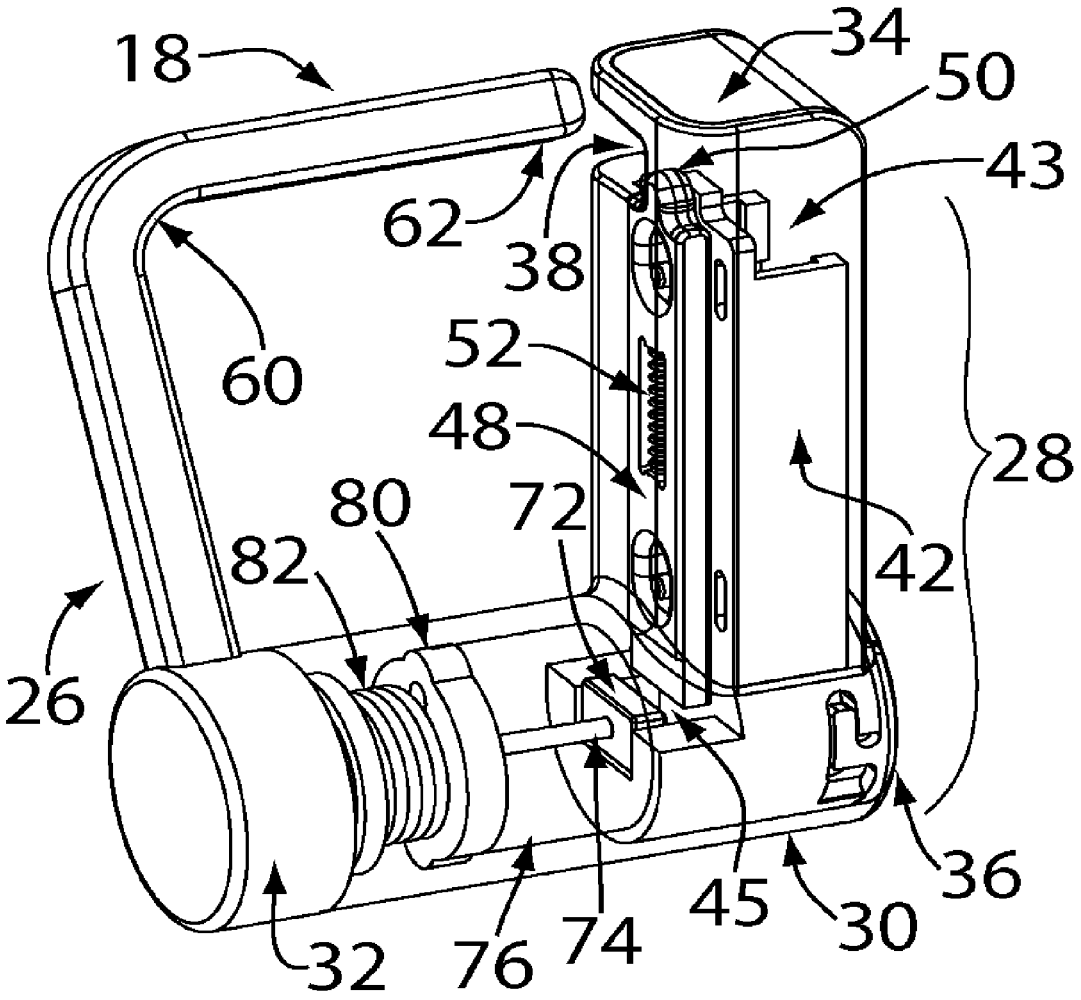
FIG. 3*a* is a side isometric semi-transparent view of a Pivot Lock in its Open configuration.
Figure 3B:
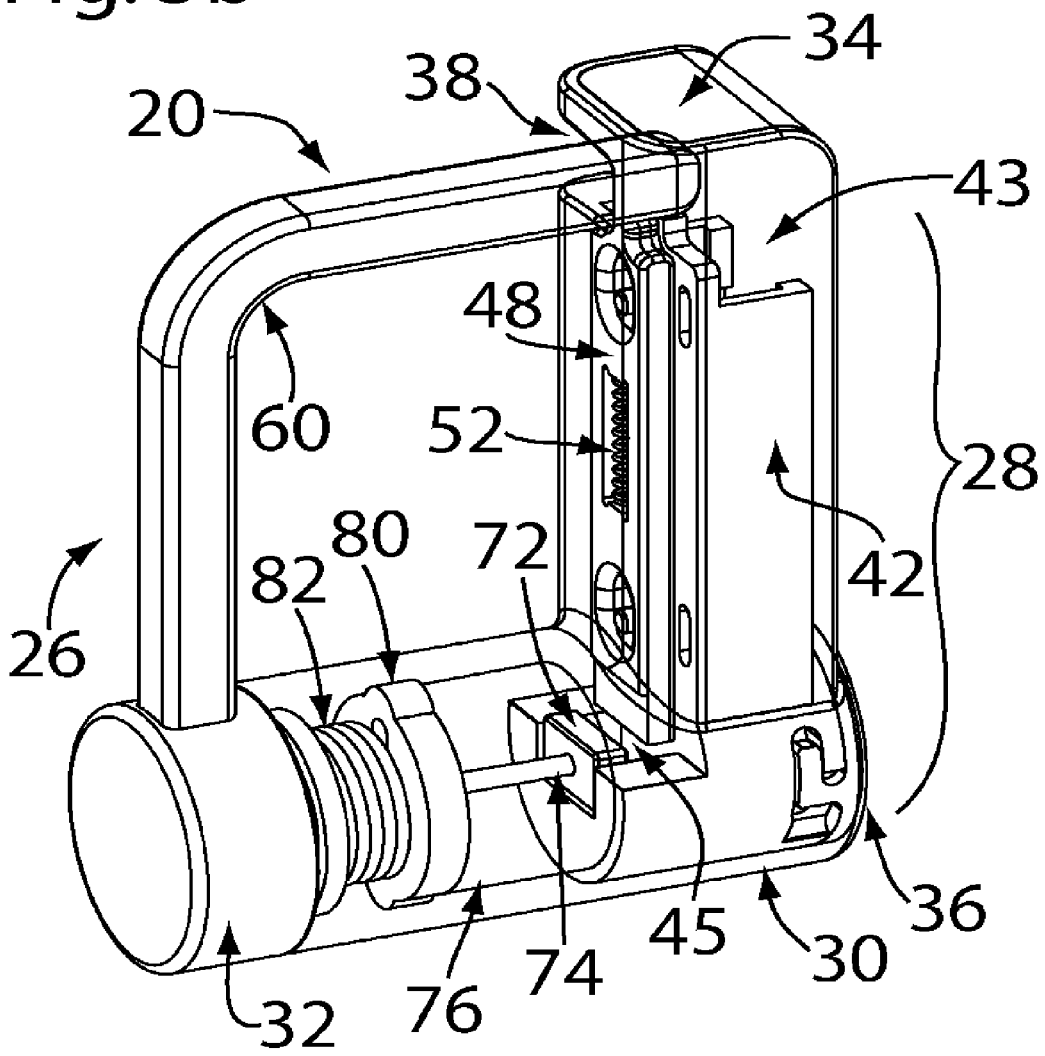
FIGS. 3*b* & 3*c* are corresponding views of a Pivot Lock in Latched & Locked configurations.
Figure 3C:
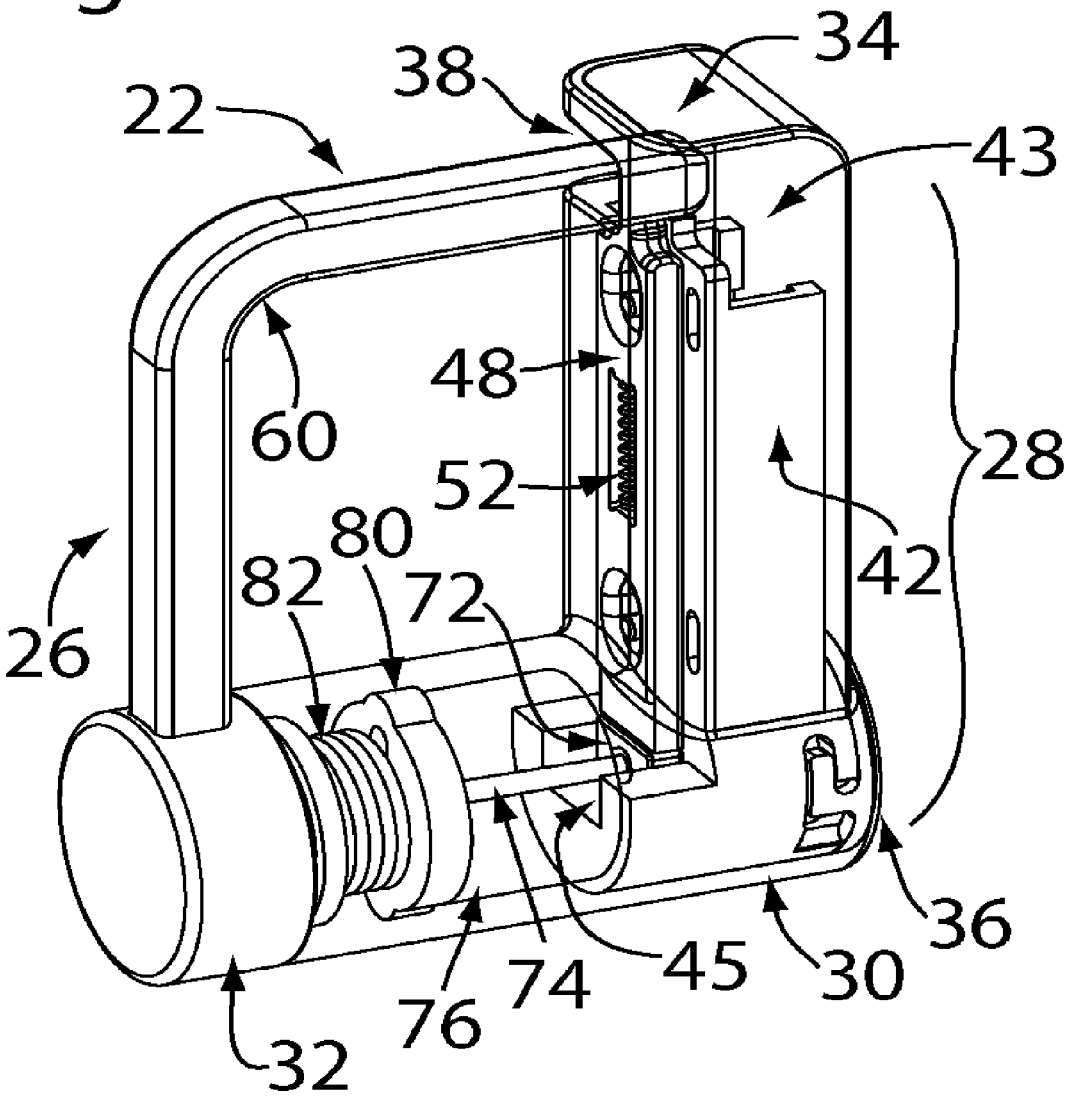

FIG. 3*a* shows a side isometric semi-transparent view of a pivot lock 26 in its open 18 configuration as a user pivots the shackle 60 away from the torsional force of the pivot spring 82 by pushing on the shackle 60 arm. In this configuration, the striker plate 48 can be manually depressed by its latch pin 50 into the block guide 45 because the locking block 72 is retracted and the solenoid 76 is energized. By this means, the latching pin 50 does not prevent the user from pivoting the shackle 60, but when it is seated in its inlet 38, the pin 50 engages the divot 62 and added to the force of the pivot spring 82, the shackle 60 is prevented from disengaging the shackle inlet 38 unintentionally (i.e., is Latched). FIG. 3*b* shows a similar view of the pivot lock in its latched 20 configuration, namely when the shackle 60 is released against the torsional force of the pivot spring 82 and the latch pin 50 of the striker plate 48 is seated in the pin divot 62 of the shackle 60. The user opens 18 the pivot lock 26 by applying sufficient force to overcome the striker spring 52 which pushes the striker plate 48 into the block guide 45, as well as against the force of the pivot spring 82. FIG. 3*c* shows the locked 22 configuration, where the striker plate 48 is prevented from releasing the shackle 60 because the force of the plunger spring 78 pushes the plunger 74 and its locking block 72 into the block guide 45 when the solenoid 76 is de-energized.

Figure 4A:
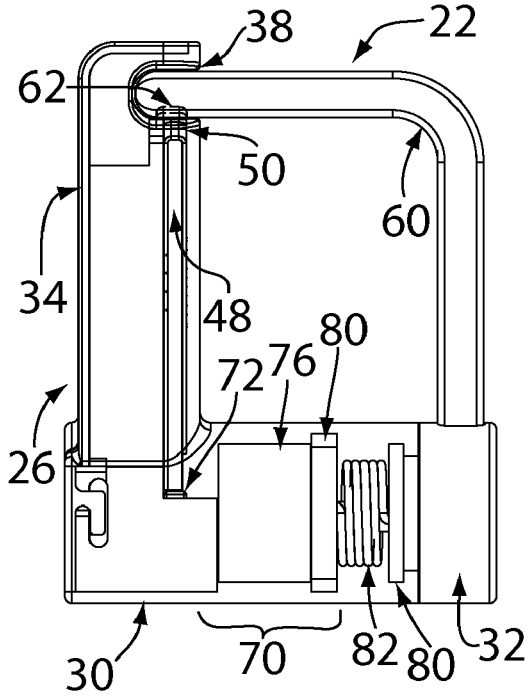
Figure 4B:
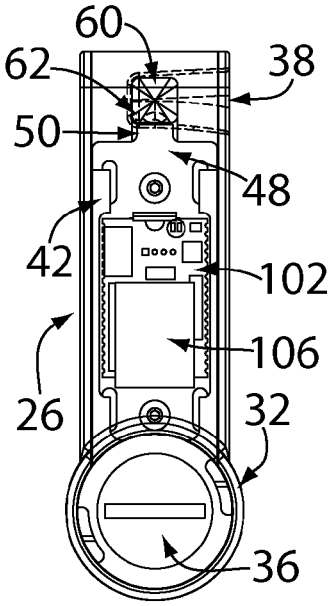
FIG. 4*b* shows an end view.

FIG. 4*a* shows a side cutaway view of a pivot lock 26 in the locked 22 configuration, exposing how the latch pin 50 of a striker plate 48 seats into the pin divot 62 of the shackle 60, and is prevented from unlocking when the locking block 72 is extended under the plate 48 by a de-energized solenoid 76 and the plunger spring 78. FIG. 4*b* shows an end view of a pivot lock 26 without its carrier cover 34, and exposing an end view of how the latch pin 50 seats into the pin divot 62 of the shackle 60 inside the shackle inlet 38.

Figure 5A:
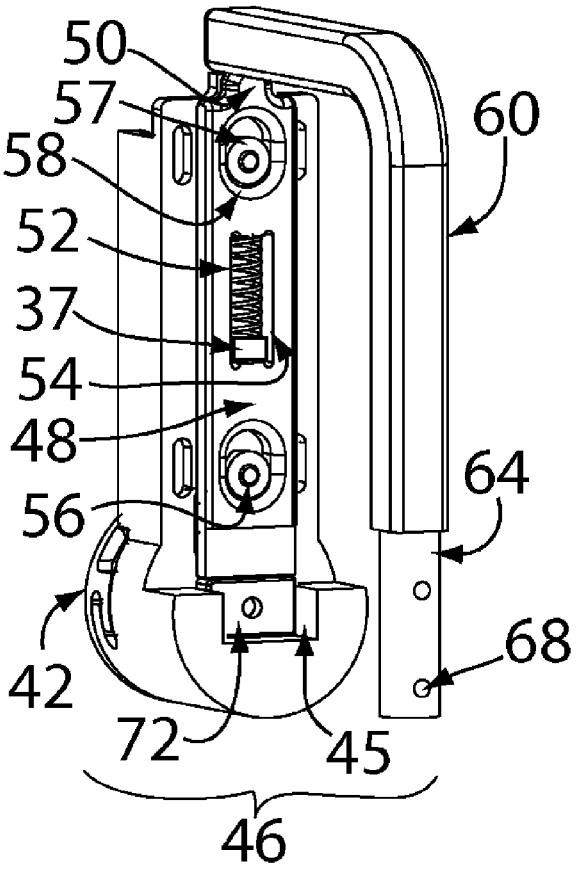
Figure 5B:
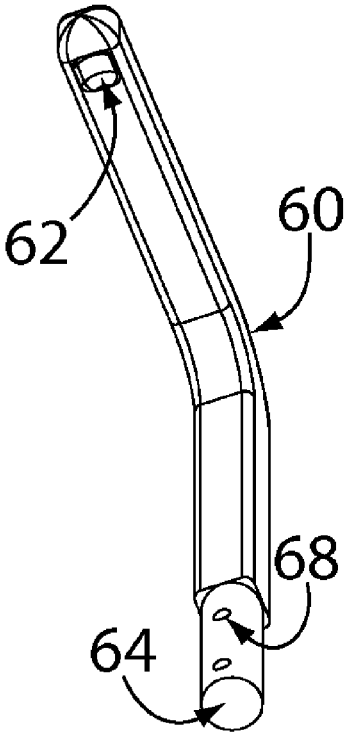
FIG. 5*b* shows an inside isometric view of an example Pivot Lock Shackle including its (Latch) Pin Divot.

FIG. 5*a* shows a side isometric view of the pivot lock mechanism 46 in its locked 22 configuration. The locking block 72 prevents downward movement of the striker plate 48 and thereby prevents the shackle 60 from pivoting because the latch pin 50 pushes into the pin divot 62, securing it into the shackle inlet 38 of the housing 28. (see FIG. 4*b*) When the locking block 72 is retracted, the striker plate 48 can move up and down as permitted by the range that the travel guides 57 can slide within the guide slots 58, as well as the tension of the striker spring 52 which is supported in a striker spring cup 37 protruding from the face of the carrier (PL) 42. FIG. 5*b* shows an inside isometric view of a pivot lock's 26 shackle 60 exposing the pin divot 62.

Clip Lock Elements

Figure 6A:
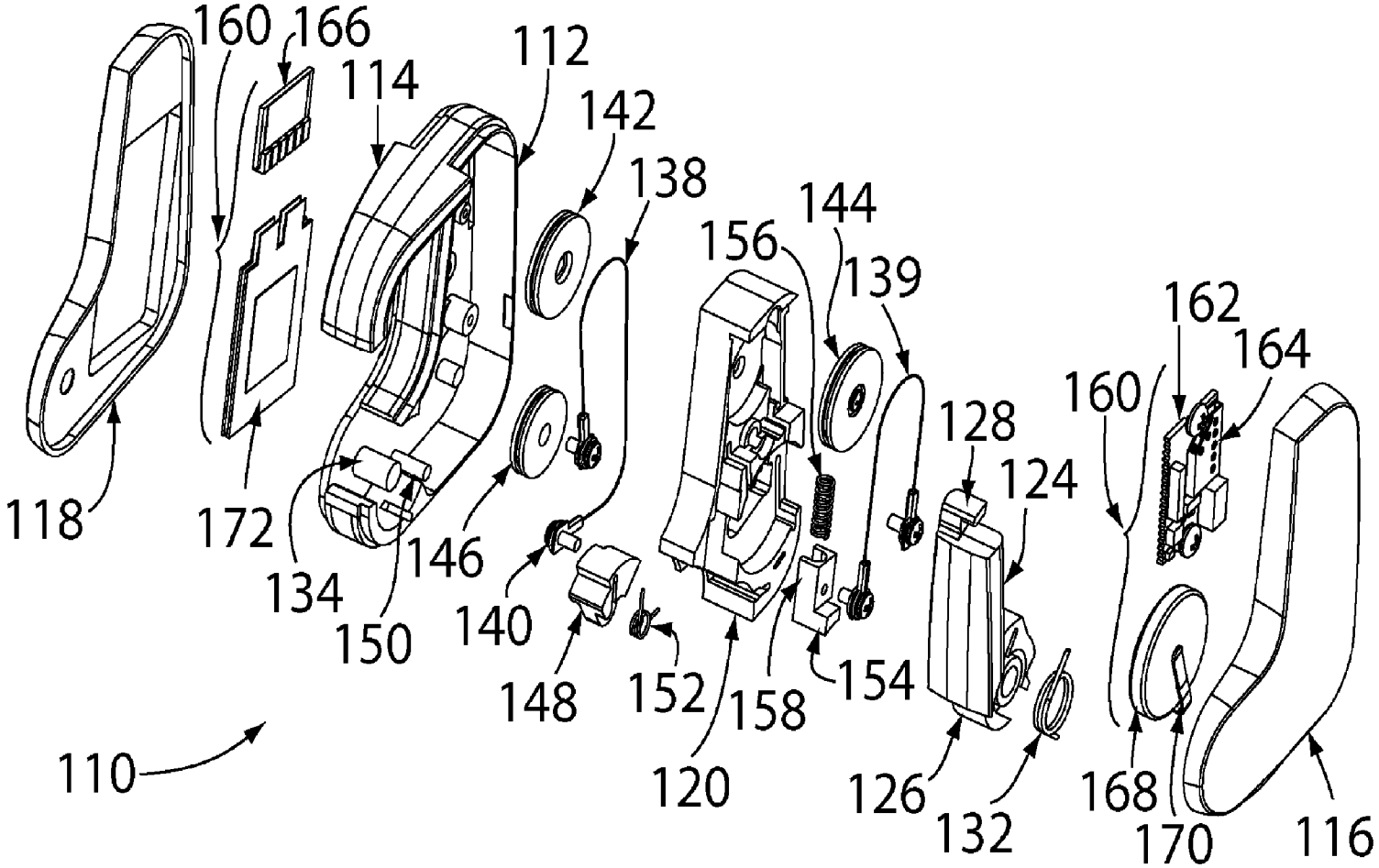
FIG. 6*a* is a front isometric exploded view of an example Clip Lock implementation of the Self-Closing Lock System.

FIG. 6*a* shows a front isometric exploded view of an example Clip Lock 110 implementation of the Portable Lock System 10. Related elements will be discussed separately as Housing, Mechanism, Actuator and Electronics.

The housing 112 of the clip lock 110 is the basic shell of the device, and includes the top part of the "clip", namely the hook 114. Most elements of the clip lock 110 are installed into, or are secured by the carrier 120, and the device is enclosed by a front cover 116 and rear cover 118.

The mechanism 122 includes the gate 124, which is the other half of the "clip" part of the lock, and it also includes its contiguous gate wheel 126, which rotates around the wheel post 134 of the housing 112. When the gate 124 connects to the hook 114, they are secured together by means of a gate interlock 128 interleaving with a hook interlock 130. (see FIGS. 8*a* & 8*b*) The gate spring 132 forces the gate 124 against the hook 114, so that when the clip lock 110 is clipped onto an item to be locked, it automatically snaps closed.

The actuator 136 comprises the following elements: a pawl wire 138 & catch wire 139 made from electrically contracting memory wire; ends of each wire length are terminated with a ring terminal crimped fastener assembly 140 which includes a ring terminal crimped to the memory wire (with each energizing power wire), a Delrin™ washer, and a nylon fastener; memory wire is guided and controlled by means of pulleys, namely a top pawl pulley 142, a catch pulley 144, and a bottom pawl pulley 146; a sprung 152 pawl 148 pivots on its housing 112 post 150 and is retracted by means of an energized pawl wire 138; a catch 154 with a seated 158 spring 156 is retracted by means of an energized catch wire 139, and thereby controls the position of the pawl 148, which locks the gate wheel 126.

Finally, the clip lock electronics 160 comprise the following elements: a main printed circuit board (PCB) 162 which includes a wireless receiver 164; a battery 168 and its conductive securement clip 170; and installed behind the rear cover 118, a switch board 166 and one or more flat pack capacitors 172.

Figure 6B:
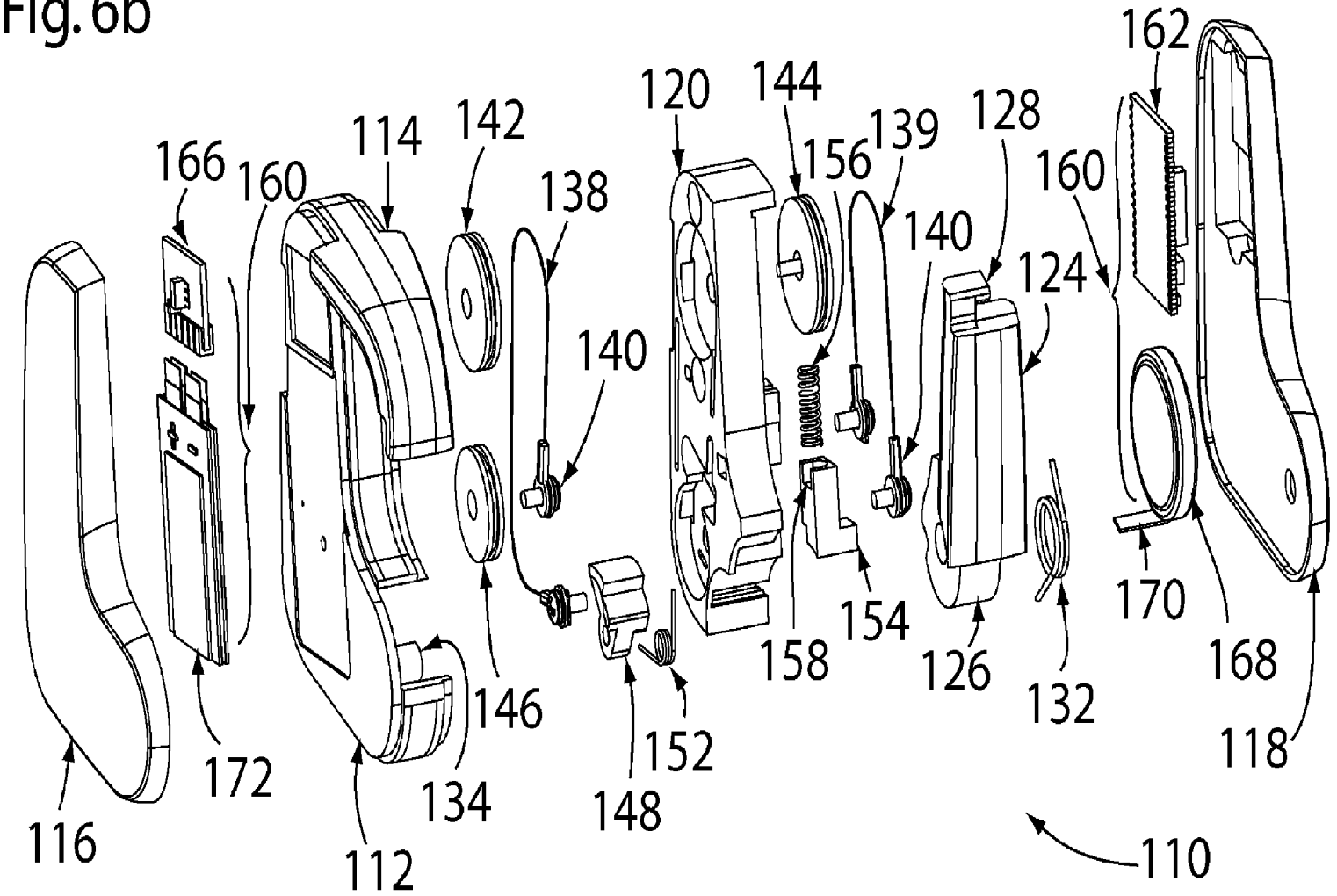
FIG. 6*b* is a rear isometric exploded view of the Clip Lock implementation.

FIG. 6*b* shows a rear isometric exploded view of the clip lock 110 elements as described for FIG. 6*a* above.

Figure 7A:
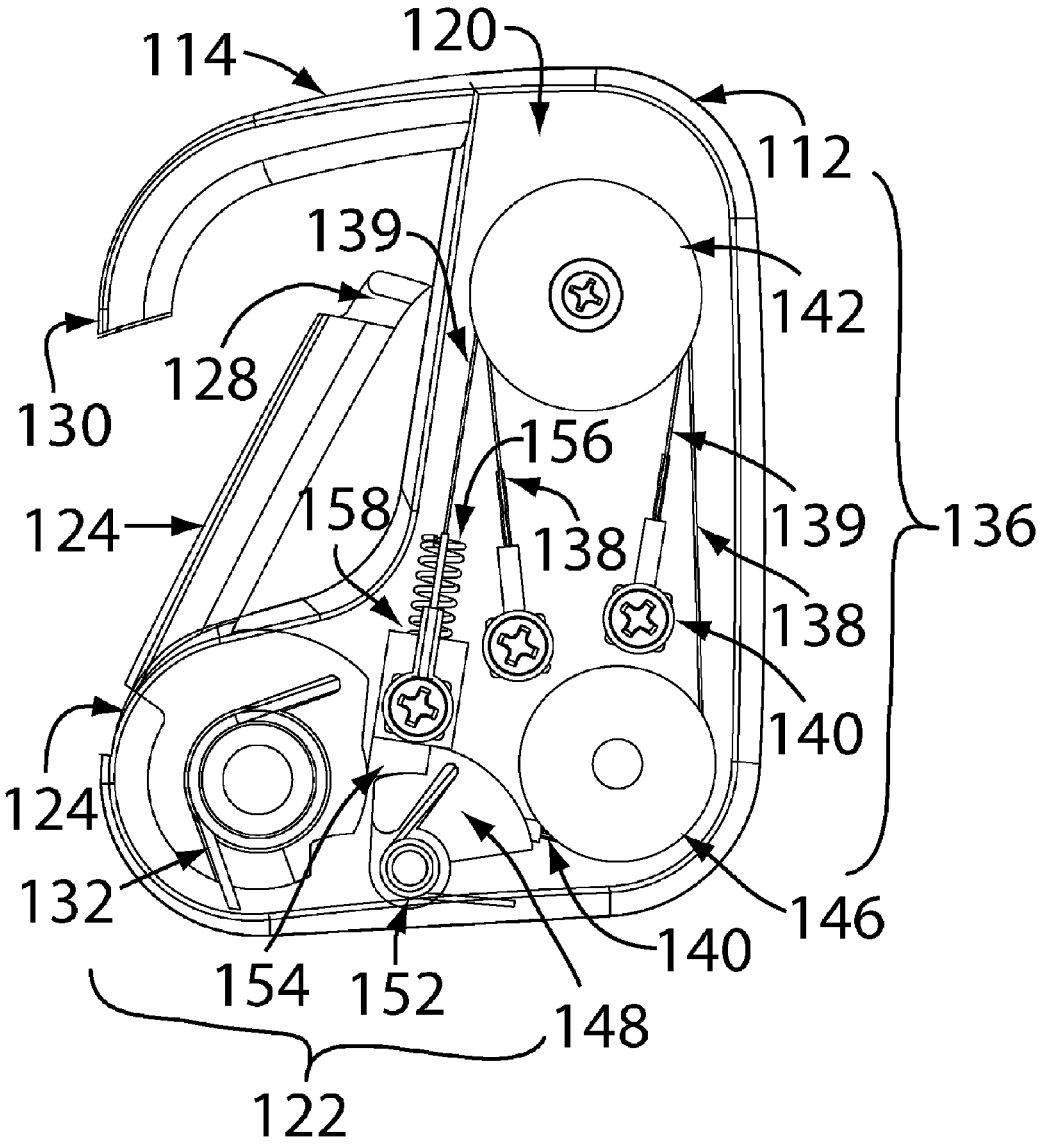
Figure 7B:
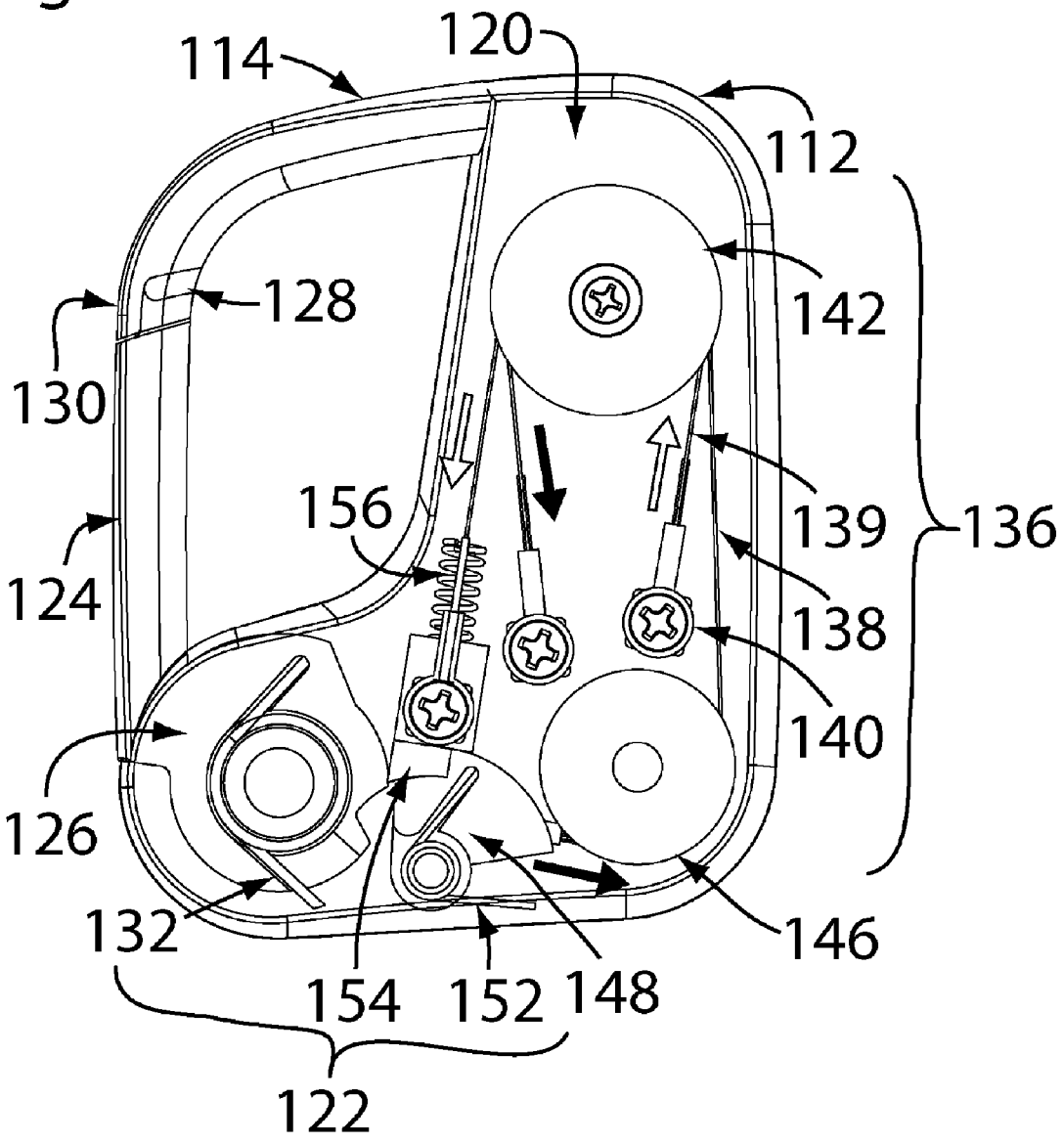
FIGS. 7*b* & 7*c* show corresponding views of the Clip Lock in Latched & Locked configurations.
Figure 7C:
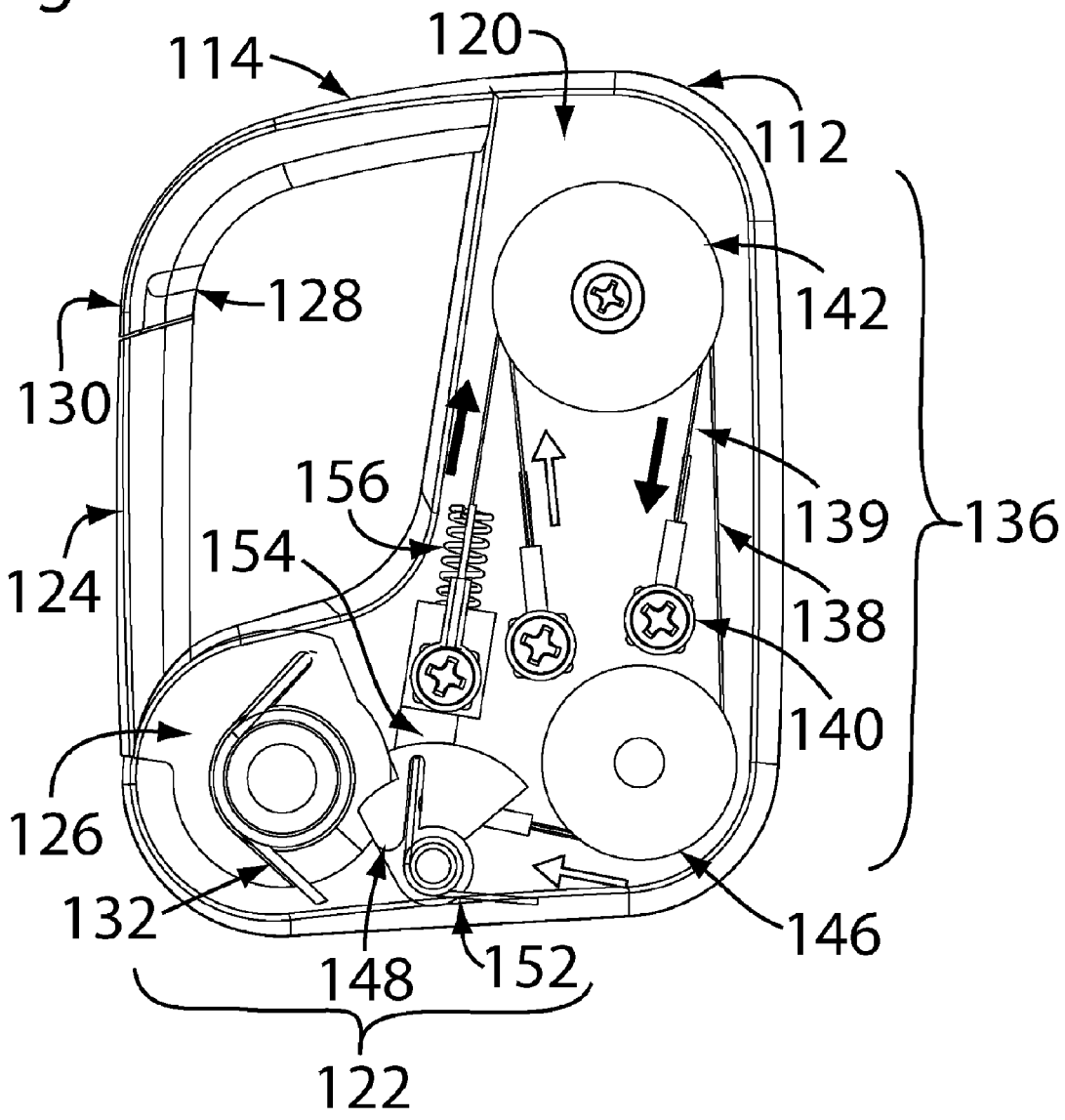

FIGS. 7*a* to 7*c* show a front view of the clip lock 110 housing 112 without electronics 160 or carrier 120 in order to reveal how control of the actuator 136 affects the configuration of locking mechanism 122. Note that in FIGS. 7*b* & 7*c*, solid wide arrows denote an energized memory wire, and open wide arrows denote a non-energized, relaxed wire. Also note that in this front view, the catch pulley 144, which is behind the top pawl pulley 142, is not visible, but is assumed to be present. (see FIGS. 6*a* & 6*b*) Pulleys guide the memory wire and rotate only enough to compensate for the strain on the wire bending around a corner when it is electrically energized.

FIG. 7*a* shows clip lock in an open configuration, with the gate 124 able to rotate on its wheel 126 with only a push against the force of the gate spring 132, and made possible because the pawl 148 is retracted by means of an energized pawl wire 138 and then held in place by means of the catch 154 with the force of the catch spring 156. In the open 18 configuration, catch wire 139 is not energized, so that the clip lock 110 can be used as an unlocked self-closing carabiner style clip device.

FIG. 7*b* shows the clip lock in a latched configuration, with the force of the gate spring 132 causing the gate 124 to fully engage the hook 114 portion of the housing 112 by means of the corresponding gate 128 & hook 130 interlocks. The solid arrows denote the direction of the contracting energized pawl wire 138, while the hollow arrows denote the direction of the non-energized catch wire 139. By this means, the gate 124 is securely latched against the hook 114 unless external force is used to counteract the torsional force of gate spring 132.

FIG. 7*c* shows the clip lock in its locked configuration, wherein the catch wire 139 is energized, retracting the catch 154 against the force of the catch spring 156, and thereby releasing the pawl 148; while simultaneously the pawl wire 138 is de-energized, allowing the force of the pawl spring 152 to rotate the pawl 148 forwards to engage a corresponding notch in the gate wheel 126, and thereby securely locking the gate 124.

Figure 8A:
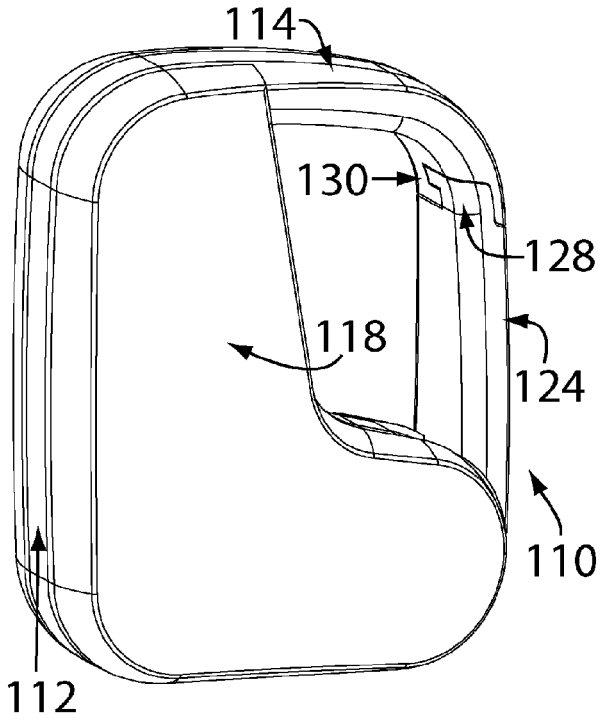
FIG. 8*a* is a rear isometric view of the gate & hook interlocks of a Clip Lock in either Latched or Locked configuration.
Figure 8B:
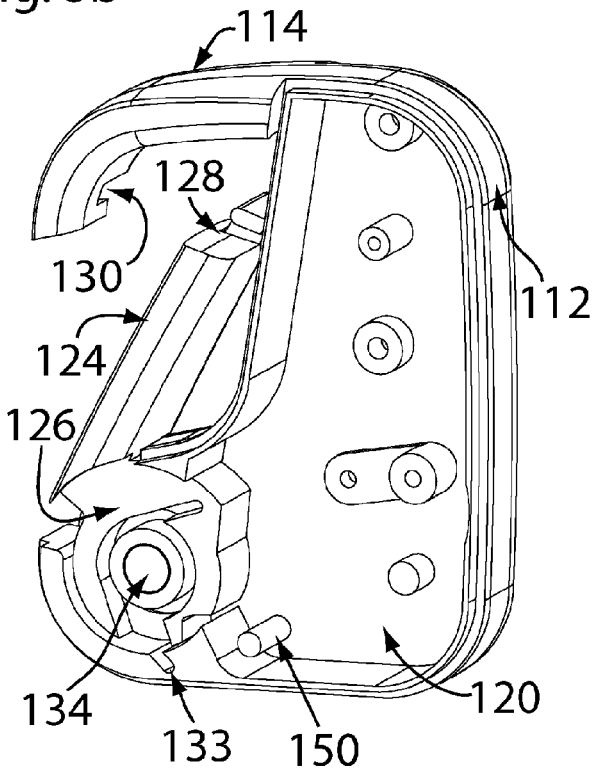
FIG. 8*b* is a front isometric view of the same interlocks in their Open configuration.

FIG. 8*a* is a rear isometric view of the gate 128 & hook 130 interlocks of a clip lock 110 in either Latched 20 or Locked 22 configuration. FIG. 8*b* is a front isometric view of a housing 112, carrier 120 and gate 124 in their Open 18 configuration. In this view, one can see the gate spring slot 133 where the end of the gate spring 132 is inserted, and which creates the spring action for the gate 124. As in FIG. 8*a*, one can see how the gate 128 & hook 130 interlocks fit together to prevent the gate 124 from further forward rotation, and to increase the security of the clip lock 110.

Pivot Lock (Motor Actuated) Elements

The Pivot Lock (Motor Actuated) 180 version of the previously disclosed Pivot Lock 26 includes the following three improvements, namely motor lock actuation, locking battery & carrier covers, and a novel means to externally power the pivot lock so it may be opened when internal batteries fail. The following additional figures and drawing elements pertain to this alternative embodiment.

Figure 9A:
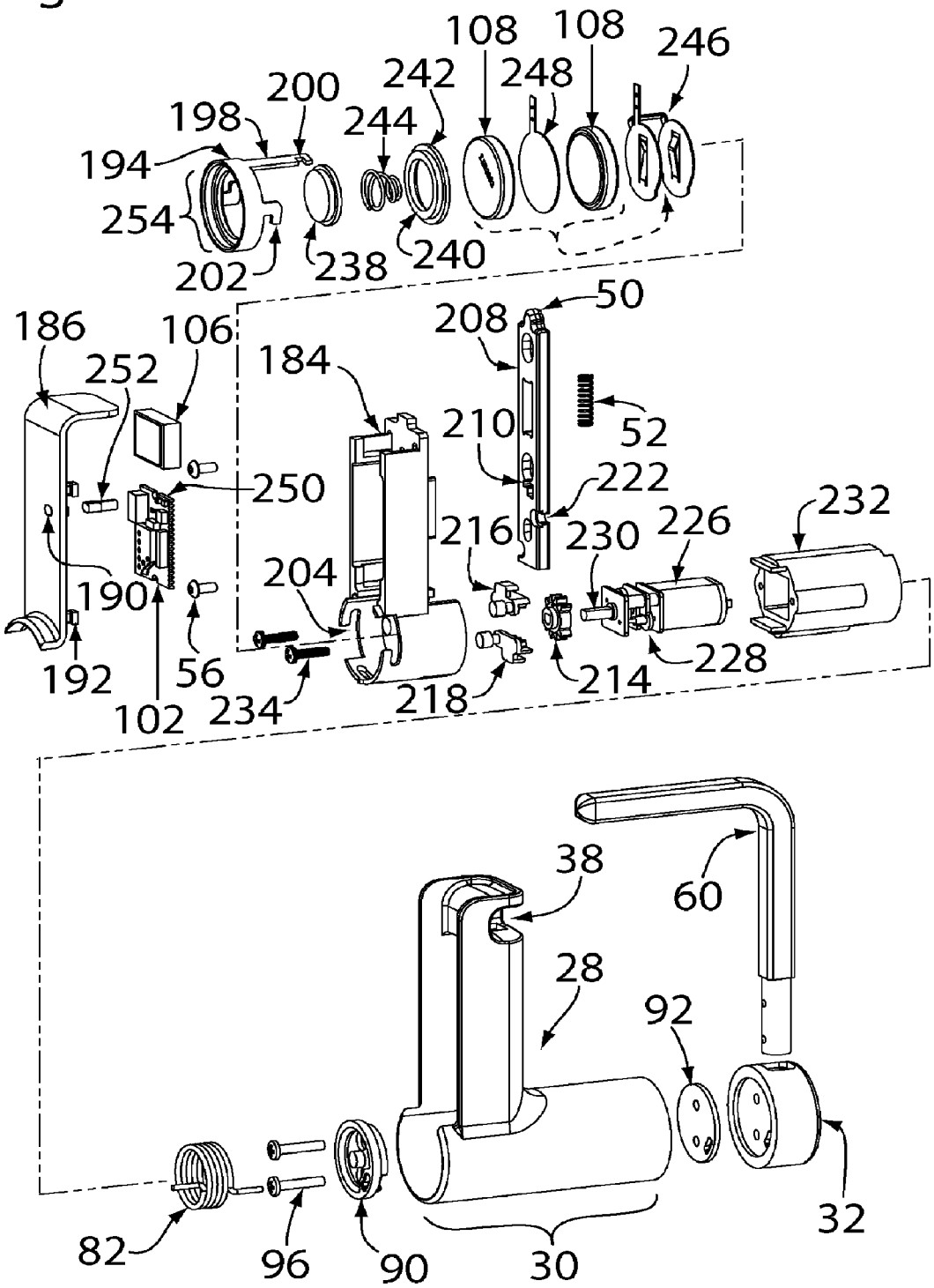
FIG. 9*a* is a side isometric exploded view of the Pivot Lock (PLM).
Figure 9B:
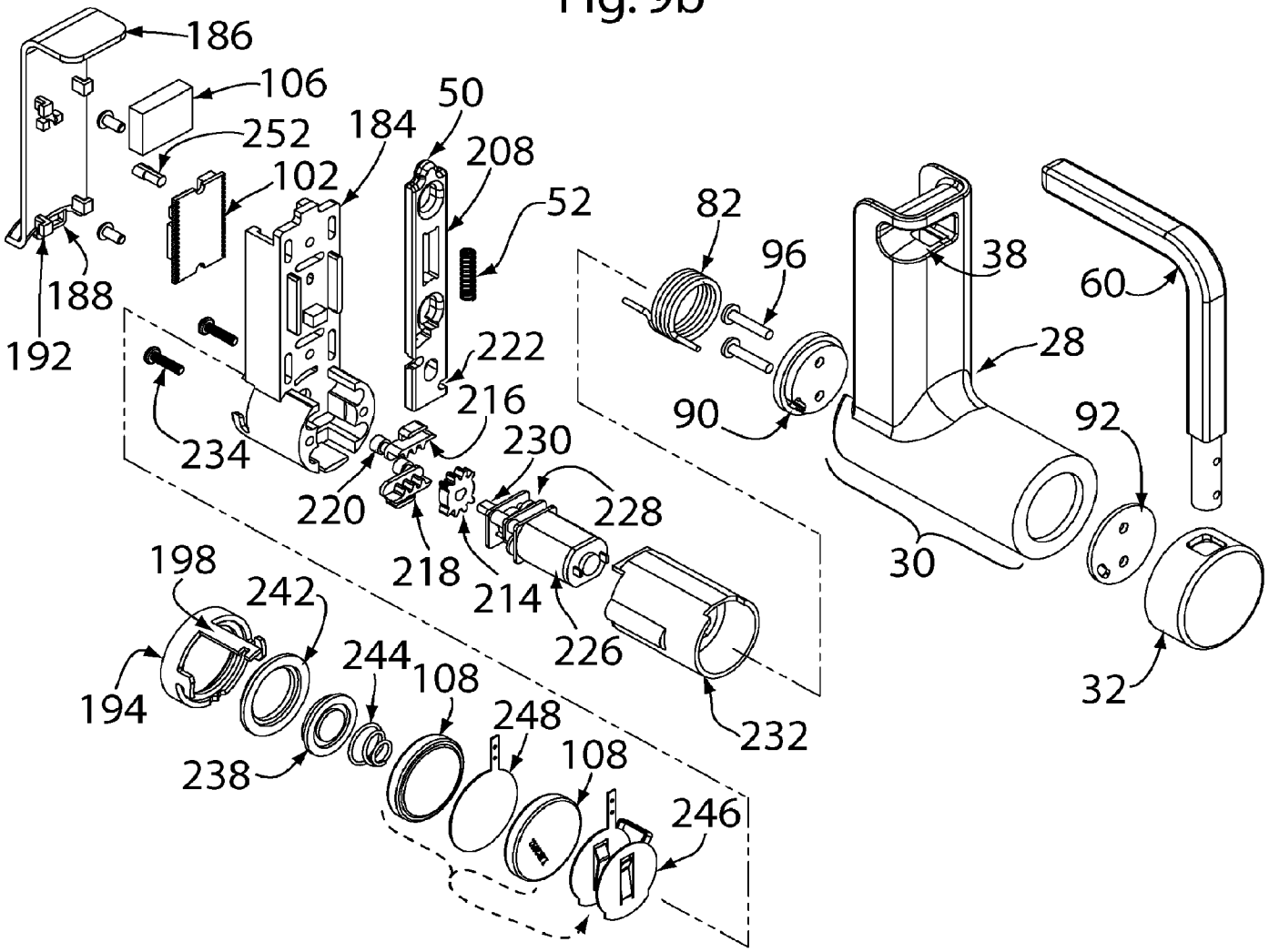
FIG. 9*b* shows a top isometric exploded view of the Pivot Lock (PLM).

FIG. 9*a* is a side isometric exploded view of the Pivot Lock (PLM) 180. Starting with those elements which can be essentially the same as in the previous pivot lock (PL) embodiment, namely the housing 28, pivot drum 30, shackle cap 32, shackle 60, shackle inlet 38, pivot spring 82, tang bolt(s) 96, shackle cap plate 90, and plate washer 92, striker spring 52, main circuit board 102 & drive circuit board 106. Then, in order to enable the above listed improvements, the following elements have been modified, namely a Carrier (PLM) 184 with cover hook receiver(s) 204; a striker plate (PLM) 208 with a tab slot 210 and stop receiver(s) 222; a locking carrier cover 186 with a tab eyelet 188 (see FIG. 9*b*), numerous carrier cover clips 192 and including a lightpipe porthole 190 with a status LED Lightpipe 252 which directs light from the status LED 250 on the main circuit board 102 as shown. The previous solenoid actuation elements have been replaced by a motor 226 with an integral reduction gear 228 and output shaft 230 keyed to a pinion 214 with its top rack 216 and bottom rack 218. The previous battery cover 36 has been replaced by a locking battery cover 194 with a locking tab 198, a tab stay hook 200, battery cover hook(s) 202, and an external battery receiver 254. The latter includes a disc like negative contact pad 238, an isolation ring 240, a positive contact ring 242, and a conical spring 244. To facilitate the voltage from an external battery 108 (see FIG. 17*c*), the internal batteries are now configured in parallel with a central positive plate 248 between two inward facing batteries 108 then sandwiched between ganged negative plates 246 as shown by the hatched bracket and arrow. FIG. 9*b* shows a top isometric exploded view of the same elements of Pivot Lock (PLM) 180 shown in FIG. 9*a*, excepting that the tab eyelet 188 provided for the locking carrier cover 186 is now visible, and the rack stop 220 of the top rack 216 has been identified.

Figures 10A, 10B, 10C:
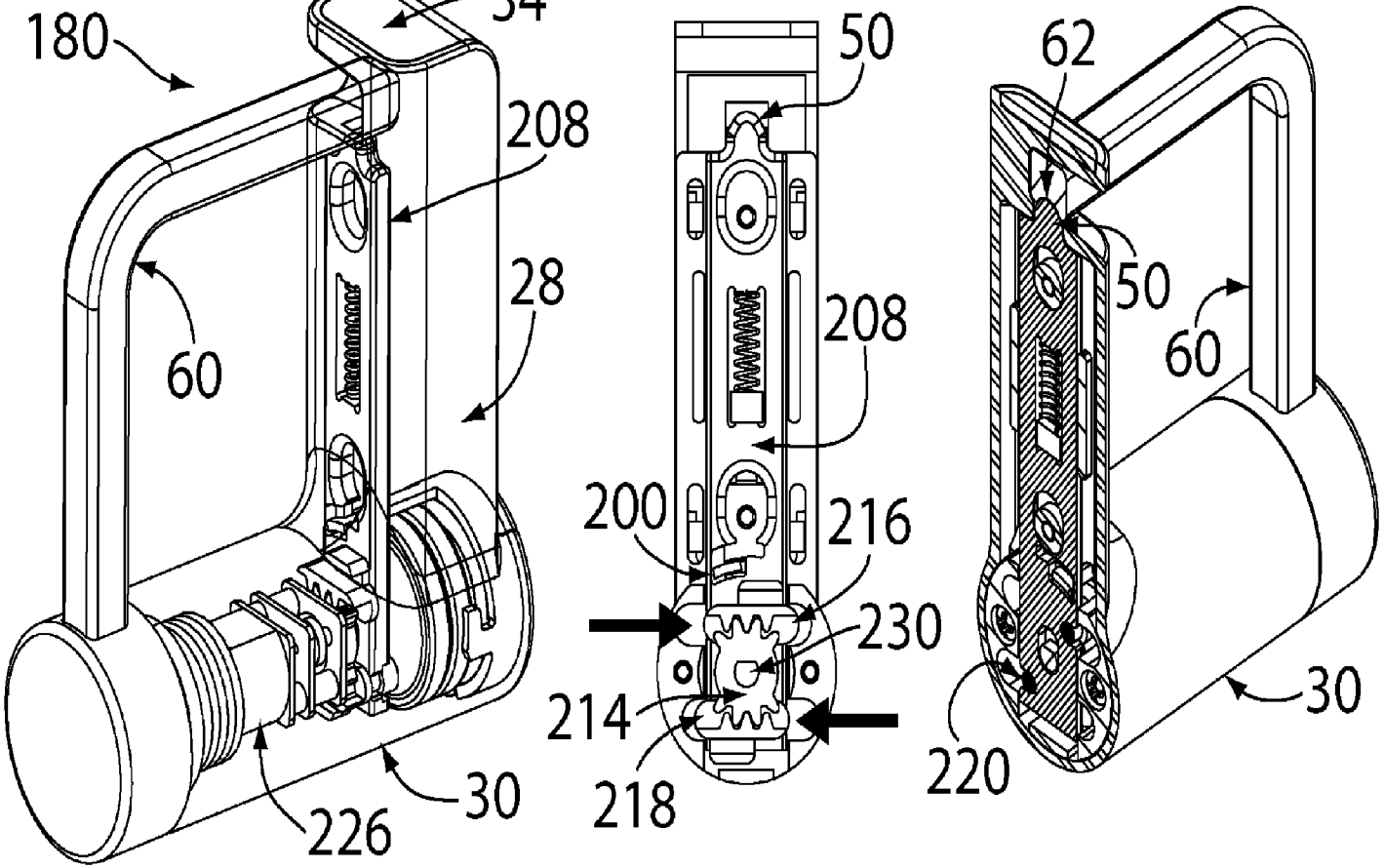
FIGS. 10*a*, 10*b* and 10*c* show isometric, end see-through and isometric cutaway views of the Pivot Lock (PLM) in its Locked State.
Figures 11A, 11B, 11C:
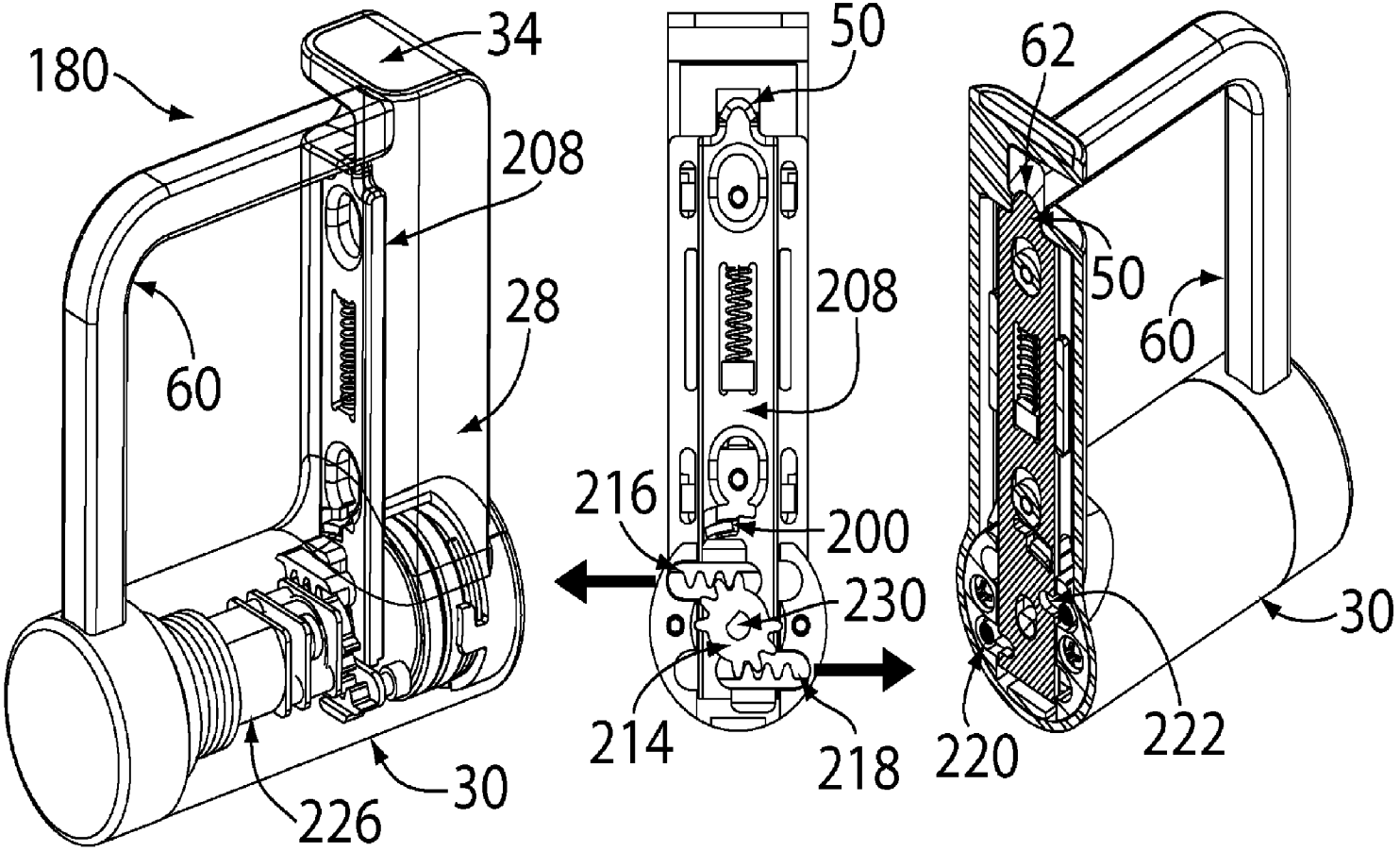
FIGS. 11*a*, 11*b* and 11*c* are isometric, end see-through and isometric cutaway views of the Pivot Lock (PLM) in its Latched State.
Figures 12A, 12B, 12C:
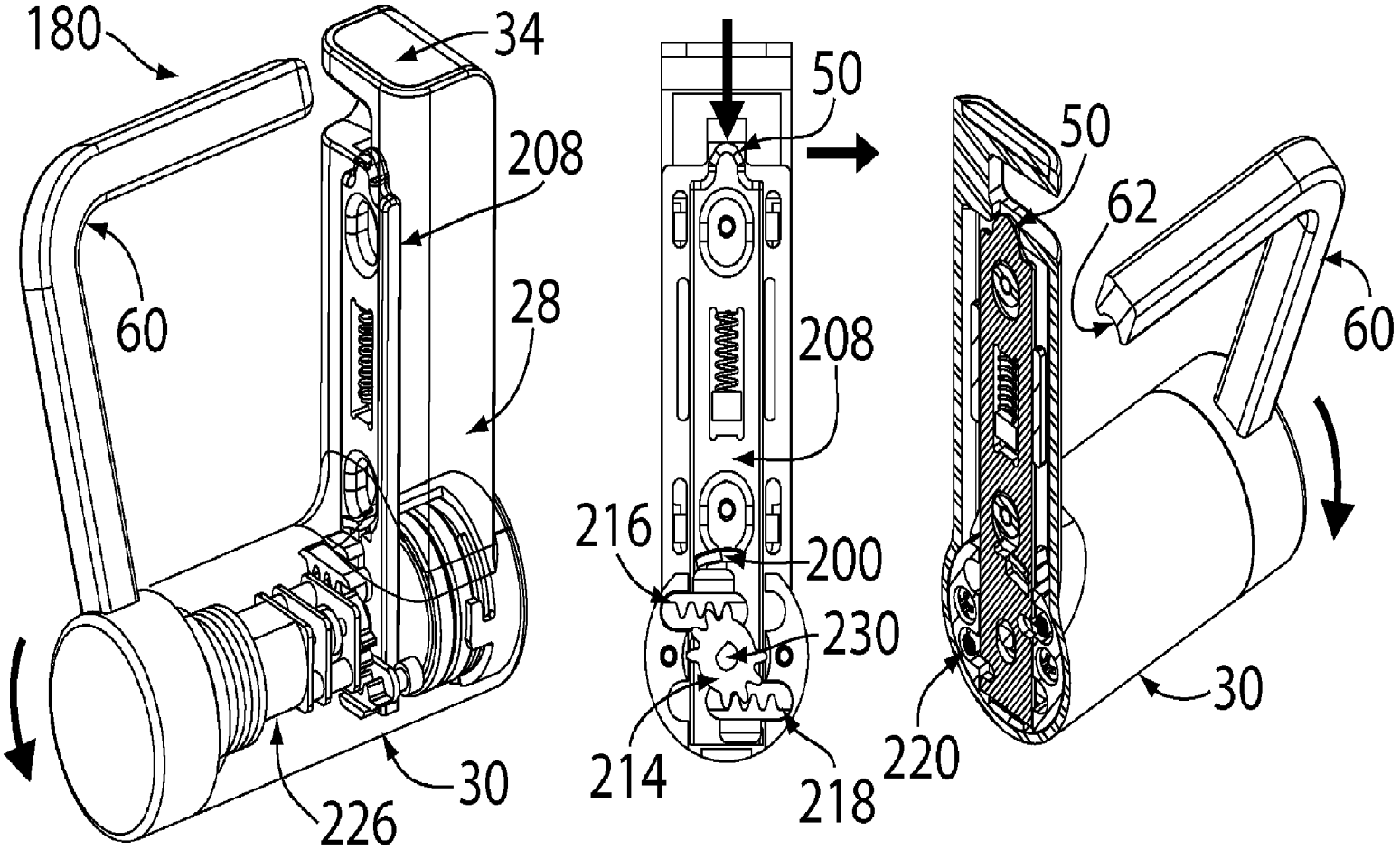
FIGS. 12*a*, 12*b* and 12*c* are isometric, end see-through and isometric cutaway views of the Pivot Lock (PLM) in its Opened State.

FIGS. 10*a*, 10*b* and 10*c* are isometric, end see-through and isometric cutaway views of the Pivot Lock (PLM) 180 in its Locked State. The key elements that determine the state (locked-latched-opened) of the Pivot Lock (Motor Actuated) 180 are the position and freedom of movement of the striker plate 208, and the position of the pinion 214, top rack 216, bottom rack 218 and their rack stop(s) 220. For this reason, these elements are made visible in the three complementary views in order to show their configuration in each state of the Pivot Lock (PLM) 180. Correspondingly, FIGS. 11*a*, 11*b* and 11*c* show isometric, end see-through and isometric cutaway views of the Pivot Lock (PLM) 180 in its Latched State and FIGS. 12*a*, 12*b* and 12*c* show isometric, end see-through and isometric cutaway views of the Pivot Lock (PLM) 180 in its Opened State.

Figure 13A:
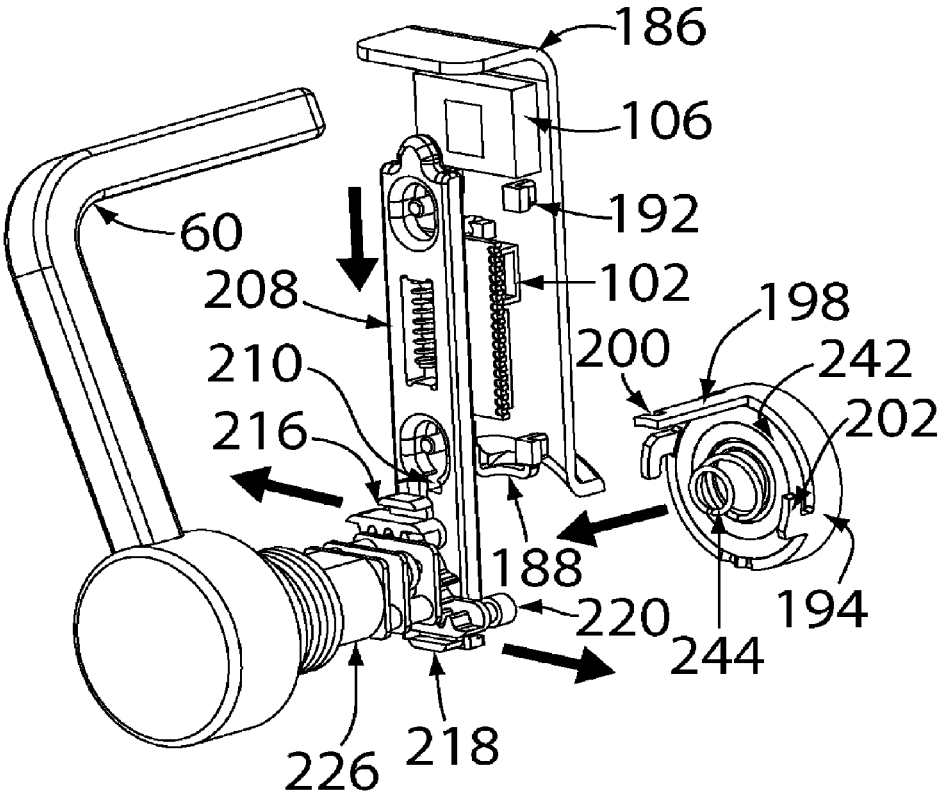
Figure 13B:
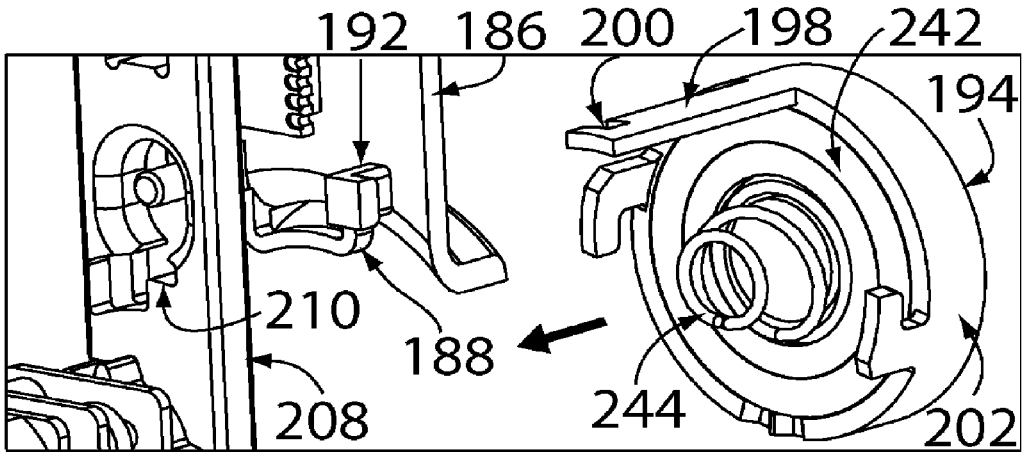
FIG. 13*b* is a detailed view of same. (Note: certain elements that do not relate to illustrating how covers are secured are not shown)

FIG. 13*a* shows an isometric overview of the assembly of the Locking Battery Cover 194 and Locking Carrier Cover 186 while the Pivot Lock (PLM) 180 is in the opened state, while FIG. 13*b* is a detailed closeup view of same. (Note: some elements not related to illustrating how each cover is secured are not shown in this Figure.) The locking battery cover 194 includes a locking tab 198 with a tab stay hook 200 which fits through a tab eyelet 188 at the bottom of the locking carrier cover 186, as well as through the tab slot 210 in the Striker Plate (PLM) 208. FIGS. 13*a* and 13*b* also show the open position of top rack 216 and bottom rack 218 so that their rack stop(s) 220 are not engaged with the corresponding stop receiver(s) 222 on each side of the bottom of the Striker Plate (PLM) 208. (also visible in FIGS. 9*a* and 9*b*)

Figure 14A:
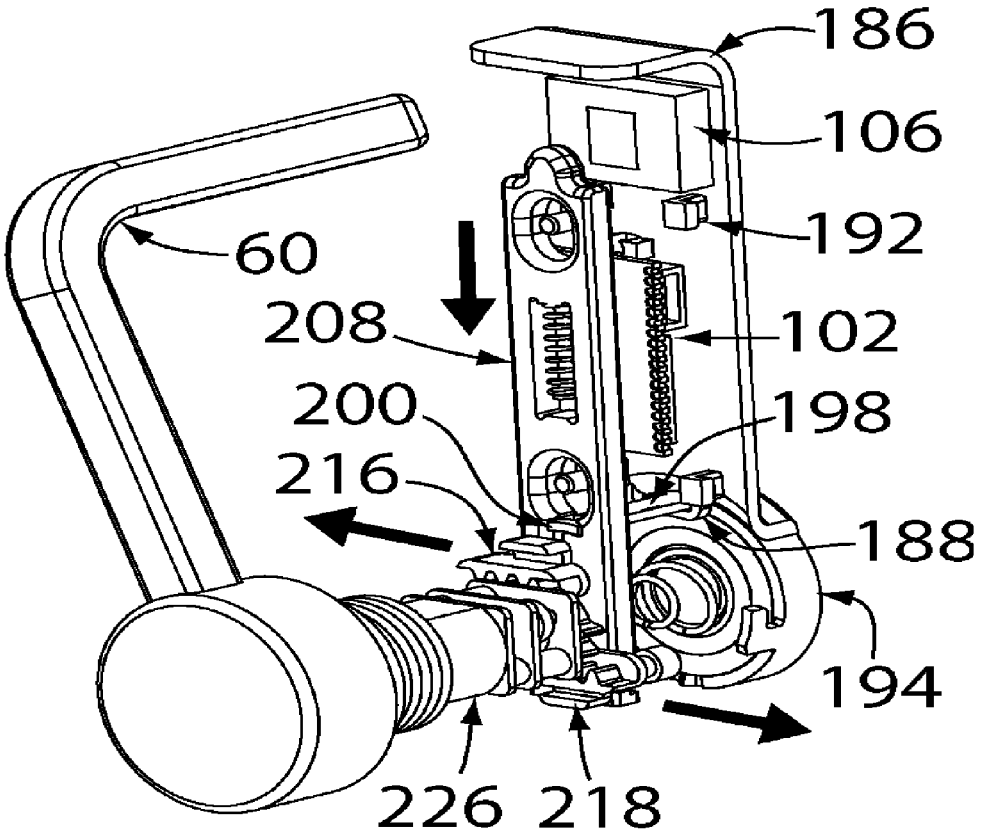
Figure 14B:
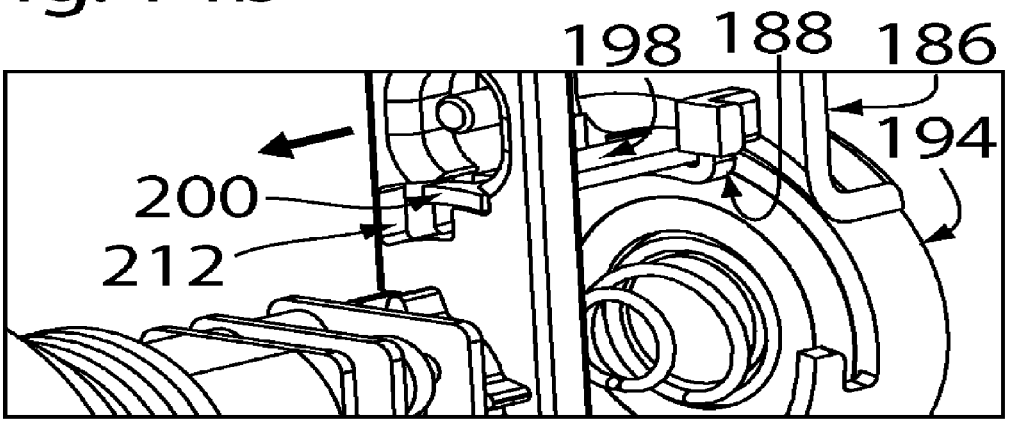
FIG. 14*b* shows a detailed view of same.

FIG. 14*a* is an isometric overview of the insertion of the Locking Battery Cover 194 and Locking Carrier Cover 186 while the Pivot Lock (PLM) 180 is in the opened state, while FIG. 14*b* shows a detailed view of same.

Figure 15A:
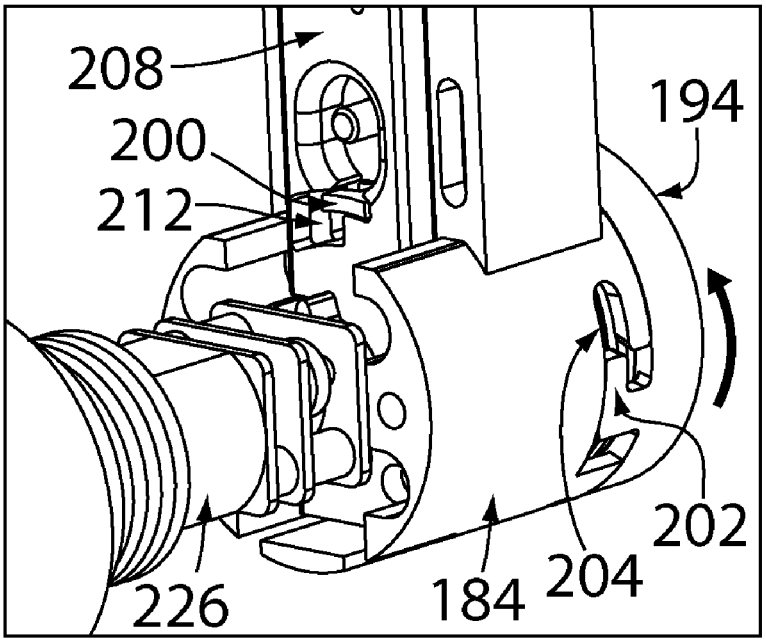
Figure 15B:
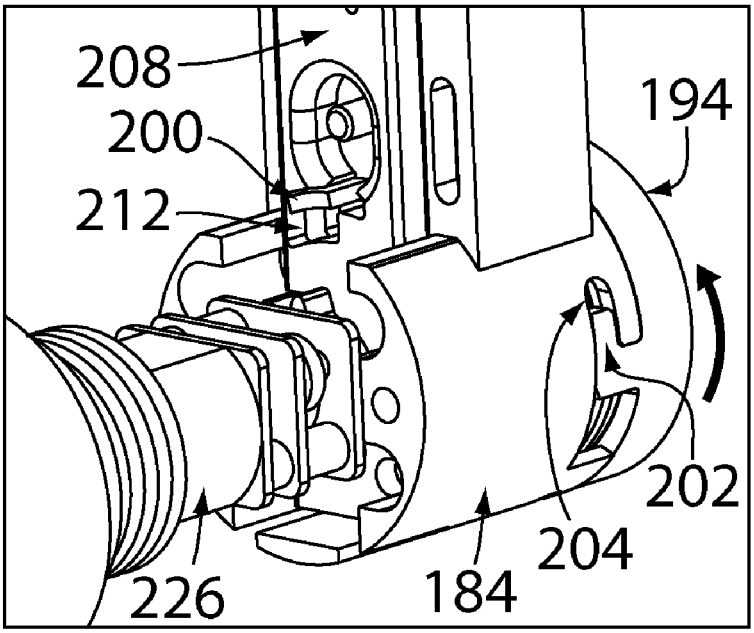
FIG. 15*b* shows its rotation into the locked position while the Pivot Lock (PLM) is in the Latched State.

FIG. 15*a* is an isometric detailed view of the assembly of the Locking Battery Cover 194 to the Carrier (PLM) 184 while the Pivot Lock (PLM) 180 is in the opened state, showing how the battery cover hook 202 engages the cover hook receiver 204. FIG. 15*b* shows the rotation of the locked battery cover 194 into its locked position, including engagement of its tab stay hook 200 with the tab stay 212 in the Striker Plate (PLM) 208. Note that when the locked battery cover is in this position, the Pivot Lock (PLM) 180 is in the Latched State, so that the Striker Plate (PLM) 208 is free to move vertically.

Figure 16A:
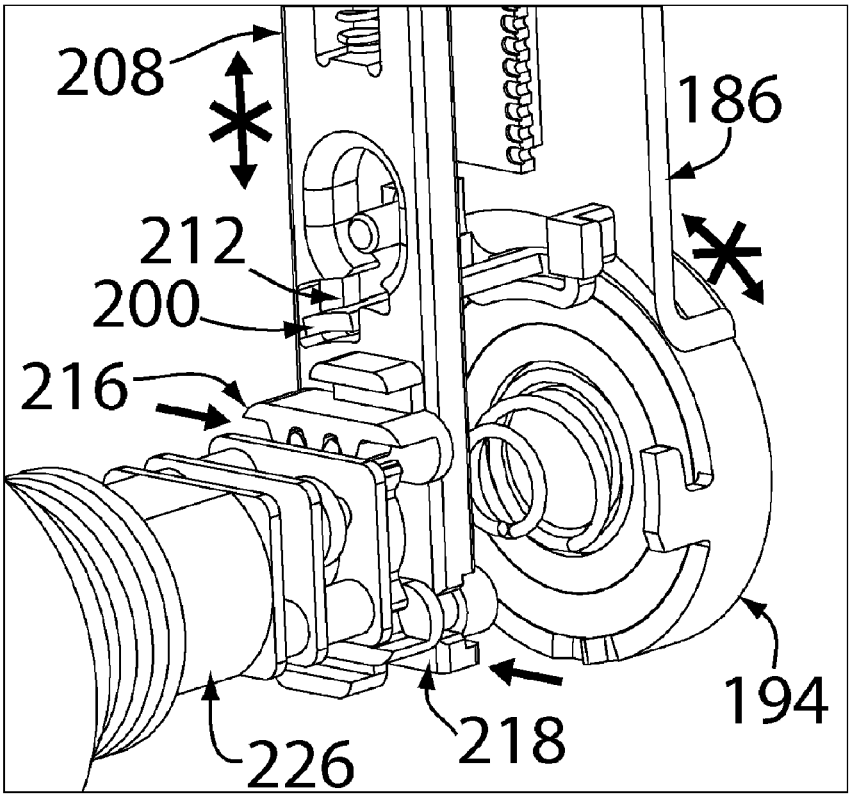
FIG. 16*a* is an isometric detailed view of Locking Battery & Carrier Covers when the Pivot Lock (PLM) is in the Locked State.

FIG. 16*a* is an isometric detailed closeup view of the Locking Battery Cover 194 & Locking Carrier Cover 186 when the Pivot Lock (PLM) 180 is in the Locked State. In this state, the top rack 216 and bottom rack 218 bind the Striker Plate (PLM) 208, the locking battery cover 194, and the locking carrier plate 186 in position as shown by the illustrative arrows.

Figure 16B:
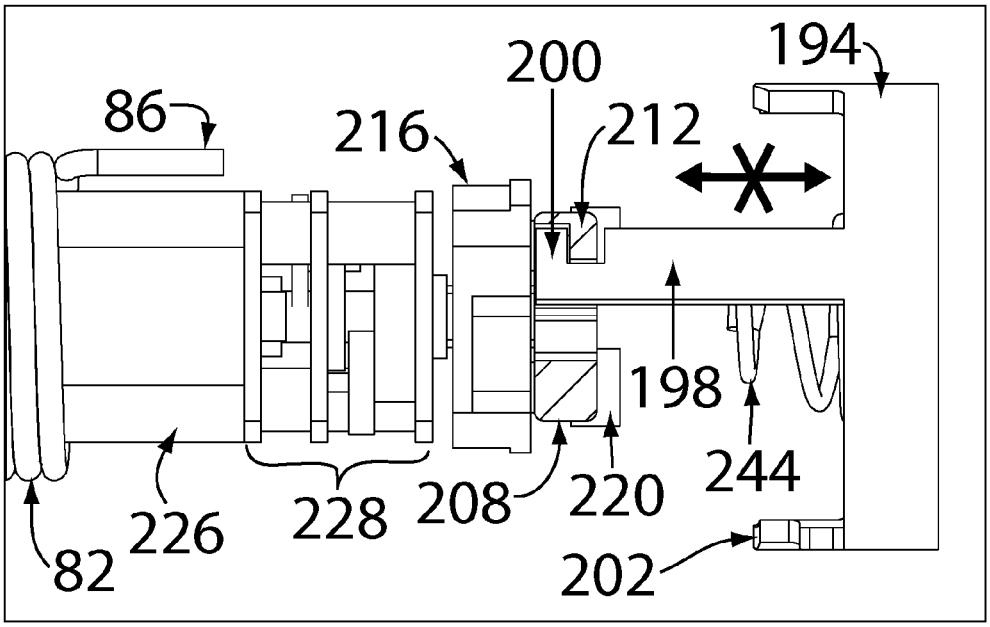
FIG. 16*b* shows a detailed cutaway top view of the Tab Stay Hook engaging the Tab Stay inside the Striker Plate (PLM), and associated elements.

FIG. 16*b* is a detailed cutaway top view of the Tab Stay Hook 200 engaging the Tab Stay 212 inside the Striker Plate (PLM) 208 which prevents removal of the locked battery cover 194. Also shown are the reduction gear assembly 228 of the motor 226 and the pivot spring end 86 of the pivot spring 82.

Figure 17B:
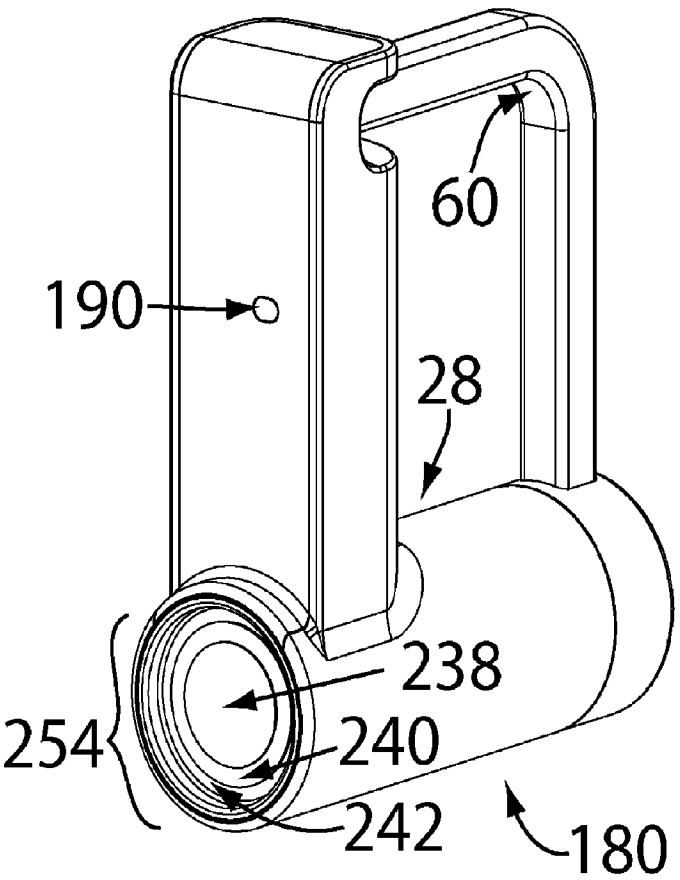
FIG. 17*b* is an isometric view of the Pivot Lock (Motor Actuated) with the External Battery Receiver and associated elements used to perform a jump-start opening of the lock if internal batteries become inoperative.
Figure 17A:
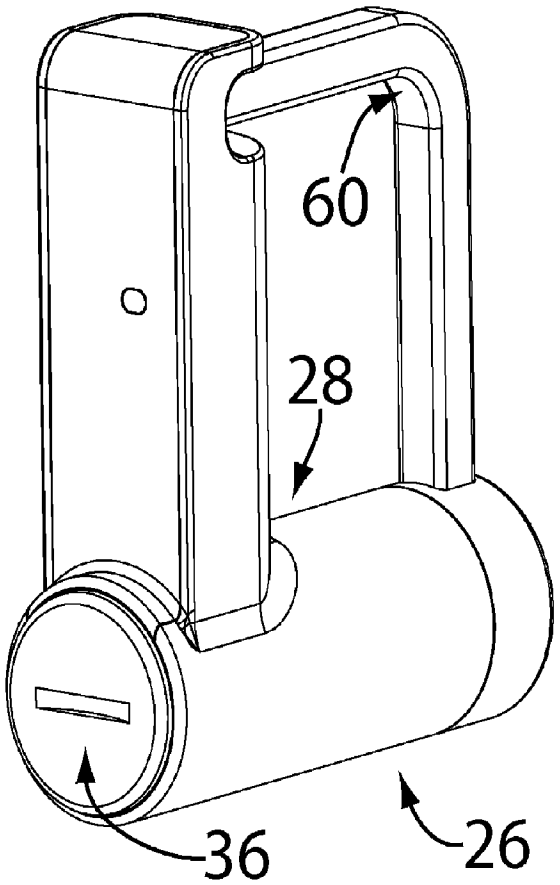
FIG. 17*a* is an isometric view of the Battery Cover (threaded) used to secure batteries inside the Pivot Lock (Solenoid Actuated).
Figure 17D:
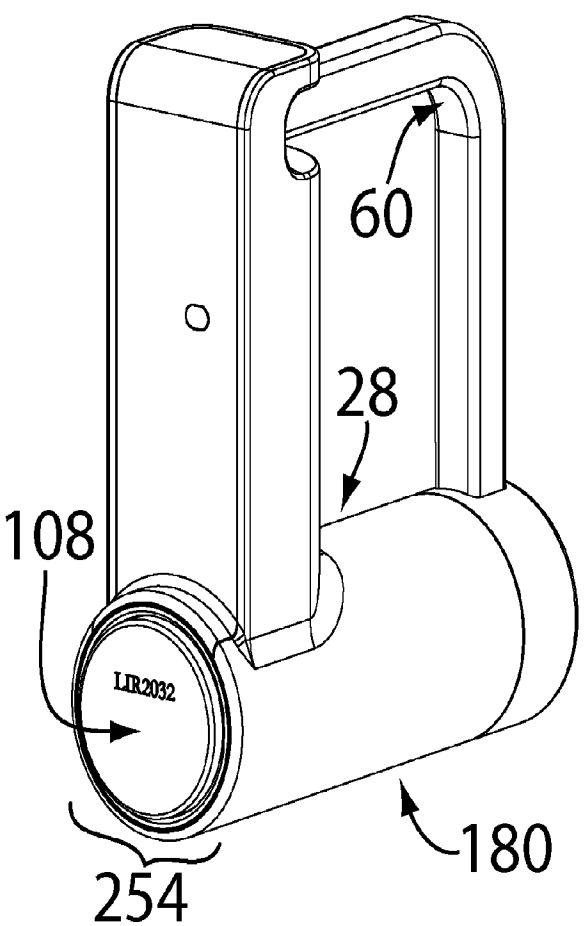
FIG. 17*d* shows its completed installation.
Figure 17C:
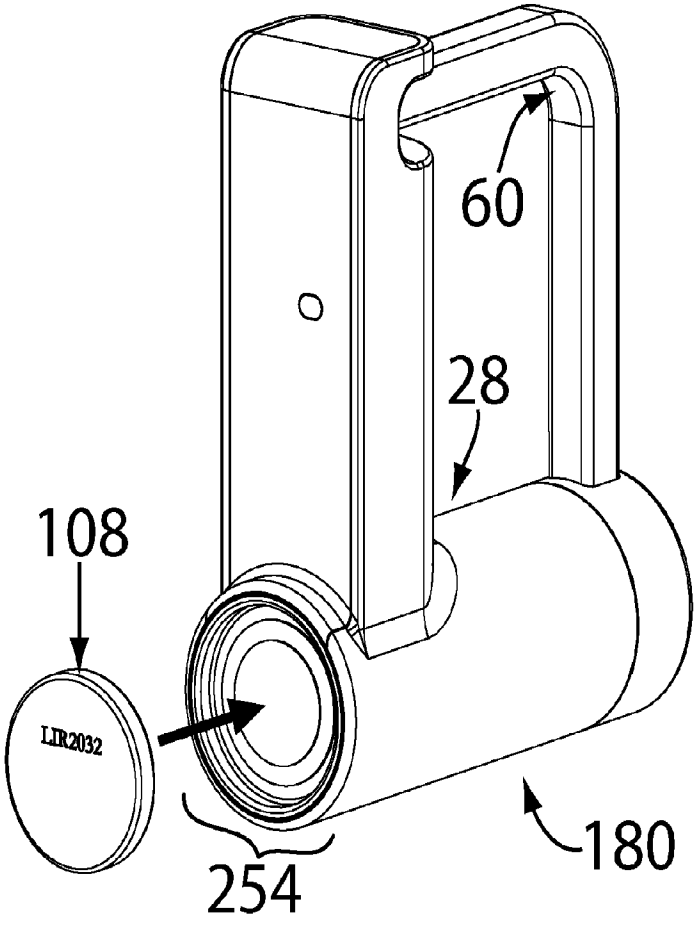

FIG. 17*a* is an isometric view of the Pivot Lock (Solenoid Actuated) 26 with its Battery Cover 36 (rotating) used to hold batteries inside the lock body as shown in FIG. 2*a*. FIG. 17*b* shows an isometric view of the Pivot Lock (PLM) 180 with the External Battery Receiver 254 (part of the locking battery cover 194 shown in FIG. 9*a*) including its contact pad 238, isolation ring 240 and contact ring 242. FIG. 17*c* shows an isometric view of the PLM 180 with an emergency jumpstart battery 108 about to be inserted into the receiver 254, while FIG. 17*d* shows its completed installation.

Figure 18A:
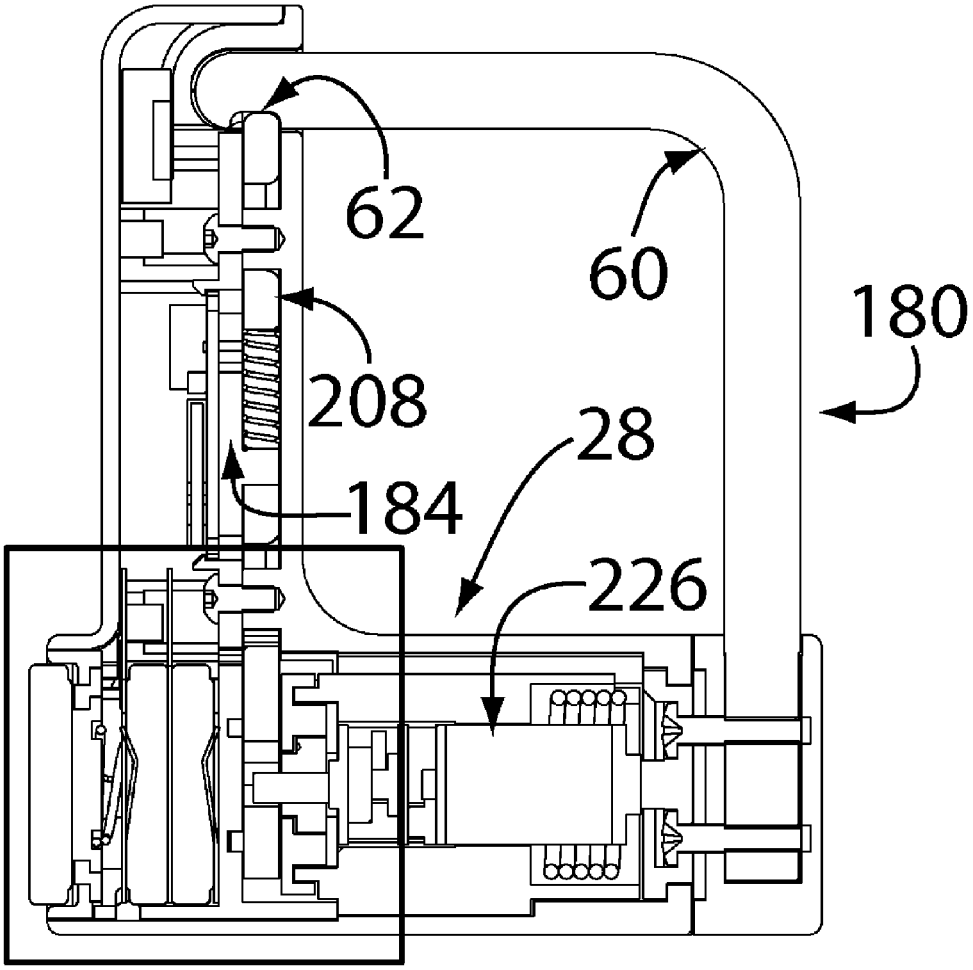
FIG. 18*a* is a side cutaway overview of the PLM with the enclosed area highlighting the jumpstart and power elements enlarged for clarity in FIG. 18*b*.
Figure 18B:
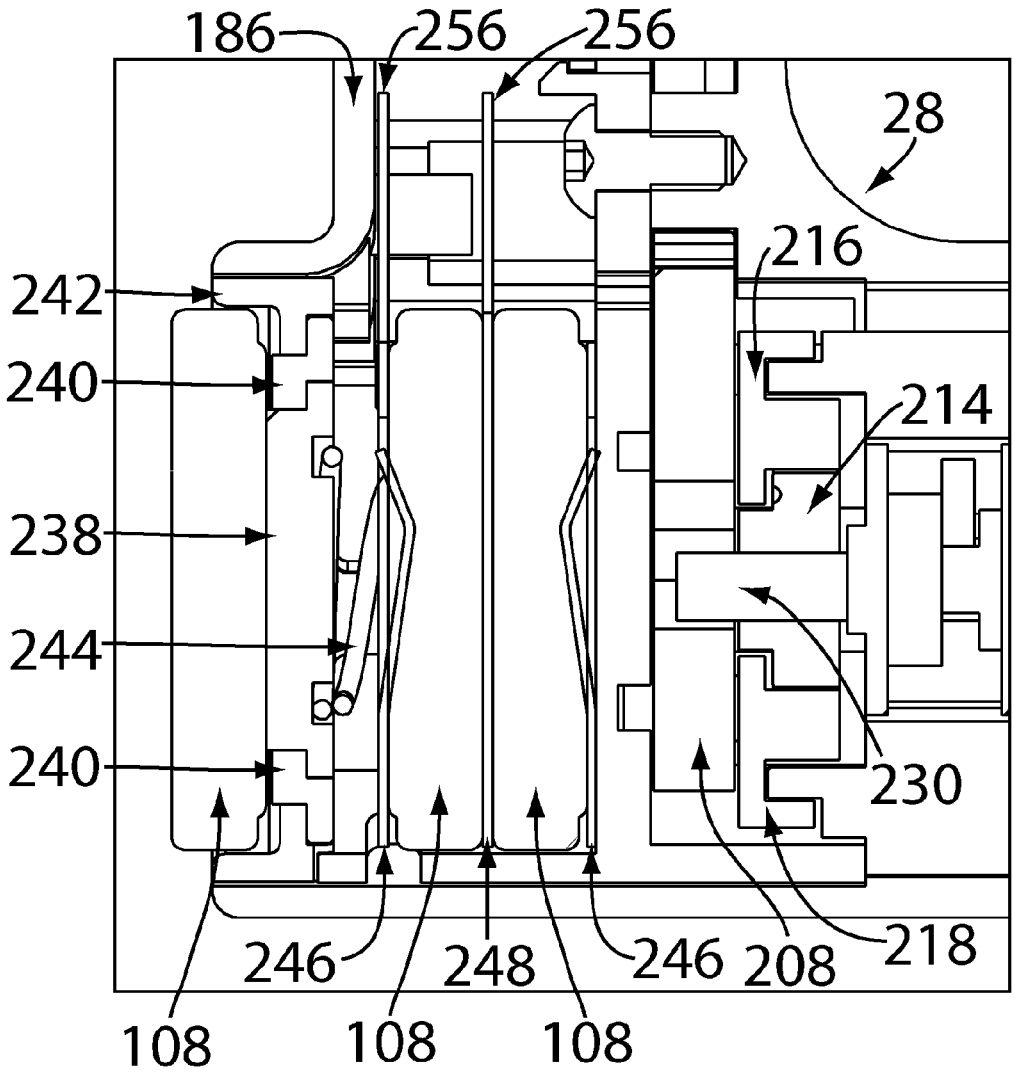

FIG. 18*a* is a side cutaway overview of the PLM 180 with the enclosed area highlighting the external battery jumpstart and internal power elements enlarged for clarity in FIG. 18*b*. As also shown in FIGS. 9*a* & 9*b*, the positive side of each internal battery 108 contacts the positive plate 248 and the negative sides of the sandwich are enclosed by ganged negative plates 246. Each plate termination connects to a wire to Bluetooth™ receiver 256 and any other parts of the lock that require power as needed. An external battery 108 is shown in contact with the negative contact pad 238 and its spring 244, as well as with the positive contact ring 242. Note that a switch (not shown) may be provided to disconnect the external battery elements when not needed and to prevent possibly damaging multiple power sources or shorting.

A preferred example embodiment of the Wireless Self-Closing Portable Lock System 10 will now be described in detail. Note that a wide range of implementations of the preferred embodiment, namely the pivot lock 26, with its solenoid or motor actuation, and clip lock 110 versions, may employ substantially functionally equivalent mechanisms, actuators and electronics. Other embodiments are not ruled out or similar methods leading to the same result. The following implementations will be discussed in the following order, namely pivot lock (solenoid actuated), pivot lock (motor actuated) and clip lock.

Pivot Lock (Solenoid Actuated) Implementation

As outlined in FIG. 1*a*, a user loads a dedicated software application into their wireless device 12 (e.g. smartphone, tablet, pad device), and after configuration with the lock, is then able to actuate the locking mechanism 46 of their pivot lock 26 remotely by means of user input 24 to the software graphical user interface (G.U.I) 14 on their phone or other device. A Bluetooth™ wireless signal 16 from the wireless device 12 is sent to a Bluetooth™ receiver 104 on the main PCB 102 inside the pivot lock 26. The wireless signal 16 can be encrypted for security, which will then be decoded by the main PCB 102, which will then actuate the mechanism 46 to either lock or unlock the shackle 60.

The housing 28 contains the electronics 100 and the striker plate 48, while its contiguous pivot drum 30 encloses the actuator 70 and the pivot spring 82 portion of the self-closing shackle 60. The shackle 60 pivots by means of the shackle cap 32 at the end of the pivot drum 30 against the torsional force of the pivot spring 82, and is secured by means of the latch pin 50 of the striker plate 48 protruding from the pin outlet 40 inside the shackle inlet 38 at the top of the housing 28, and into the pin divot 62 of the shackle 60.

As shown in FIG. 3*b*, the latched 20 state is where the locking block at the end of the plunger 74 is retracted by the solenoid 76 which allows the striker plate 48 to freely move down into the guide slot 45 which allows the latch pin 50 to be retracted easily because it is only held in place by the force of the striker spring 52. Therefore, the latched 20 state is where the shackle is held against the shackle inlet 38 by the force of the pivot spring, and is pinned by the latch pin 50 against its pin divot 62 by the force of the striker spring 52. The user can easily open the shackle 60 by overcoming these forces, insert the lock into a hasp or similar attachment, and be assured that the pivot lock 26 will reliably return to the latched state 20 upon release.

As shown in FIG. 3*c*, the locked 22 state is where the locking block 72 at the end of the plunger 74 is released by the solenoid 76, and prevents the striker plate 48 from movement into the guide slot 45, and thereby prevents its latch pin 50 from being retracted. In the locked state 22, the latch pin 50 engages with the pin divot 62, securely locking the end of the shackle 60 into the shackle inlet 38. (See FIG. 4*a*)

The inside of the carrier (PL) 42 provides a channel in which the striker plate 48 can move, while the outside provides a bay 43 in which the electronics 100 elements of the pivot lock 26 are housed. Cylindrical travel guides 57 are secured by guide bolts 56 to the carrier 42 face, and delimit striker plate 48 travel as shown in FIG. 5*a*. The main PCB 102 includes the PL receiver 104 (Bluetooth™ or any equivalent wireless transmitting format), and any processing capability required to decode or convert the signal, and a power supply. The drive board 106 is used to supply the current needed to actuate the solenoid 76 when a control signal is received from the main PCB 102. Power is supplied by batteries 108 housed in a separate battery well 44 at the bottom of the carrier 42.

Pivot Lock (Motor Actuated) Implementation

The Pivot Lock (PLM) 180 is an alternative embodiment of the Pivot Lock (PL) 26 implementation of the Portable Lock System 10. Its primary variant is the use of a motor 226 instead of a solenoid 76 to actuate the locking mechanism. Secondary additional improvements include internally locking battery & carrier covers, and a novel means to externally power the pivot lock to allow the user to still open the lock when internal batteries fail. Each alternate and novel implementation will be discussed in more detail below.

Motor Actuation

FIGS. 10*a*, 10*b* and 10*c* to 12*a*, 12*b* and 12*c* show Locked, Latched, and Open states of the Pivot Lock (PLM) 180, respectively. As with the Pivot Lock (PL) 26, a wireless signal 16 triggers the actuator (PLM), which in this example embodiment comprises a geared motor 226 with a keyed output shaft 230 which rotates a pinion 214 wheel which slides the top rack 216 and bottom rack 218 outwards to latch, and inwards to lock the Striker Plate (PLM) 208 in place. As with the Pivot Lock (PL) 26, a Pivot Lock (PLM) 180 in the Latched state allows the latch pin 50 of the Striker Plate (PLM) 208 to be depressed against the striker spring 52, thereby allowing the user to manually rotate the shackle 60 against the force of the pivot spring 82 and thereby release the shackle from the shackle inlet 38 and open the lock as shown in FIGS. 12*a*, 12*b*, and 12*c*. As shown in FIG. 9*b*, the motor 226 is prevented from inadvertent rotation by being secured inside the motor restraint 232 casing, as well as by securing the gear assembly 228 to the bottom of the carrier (plm) 184 by means of gear-motor fasteners 234. By this means, the motor actuation is reliable and secure.

Locking Covers

A wirelessly actuated lock may be less vulnerable to combinatorial methods of unlawful entry, but if one can gain access to the interior of the lock housing, the lock is just as vulnerable to defeat. For this reason, a lock may be constructed so that the two means of access to the interior, namely the battery and carrier covers are secured while the lock is in the locked state. As shown in FIGS. 13*a* through 16*b*, once the locking carrier cover 186 is secured to the upper body of the housing 28 by means of carrier cover clip(s) 192, the locking tab 198 of the locking battery cover 194 can fit through the tab eyelet 188 at the bottom of the carrier cover 186 and then through the tab slot 210 of the Striker Plate (PLM) 208. (see FIGS. 13*a* 13*b*, 14*a*, 14*b*) As the locking battery cover 194 is rotated into place, the tab stay hook 200 now prevents the cover 194 from being removed, while also permitting the free vertical movement of the Striker Plate (PLM) 208 when in the Latched state. (see FIGS. 15*ab*, 16*b*) Finally, when in the Locked state, the tab stay hook 200 is seated at the bottom of the tab stay 212 (see FIG. 16*a*), thereby preventing the rotation of the locking battery cover 194. By this means, the Pivot Lock (PLM) 180 in the Locked state is now completely secure from external access because the carrier cover 186 cannot be slid off, nor can the battery cover 194 be rotated open.

External Jumpstart

Another issue that can affect the utility of wirelessly operable locks is an authorized user's need to be able to open the lock if the internal batteries die. For example, if Pivot Lock (PLM) 180 has a dead battery, the user is prevented from accessing the lock housing 28 in order to change batteries by the locking battery cover 194. A unique solution has been devised whereby an external battery 108 may be inserted into a receiver 254 bay on the outside of the locking battery cover 194 (see FIGS. 17*b*, 17*c* and 17*d*), and along with the wireless unlocking signal 16, and a means to bypass the dead batteries such as a mode switch or similar disconnect, emergency opening of the lock is now possible. FIG. 18*b* highlights the elements of this method, with the exception of the means to disconnect the shown connection between the contact pad 238, the spring 244, and the first ganged plate 246. A simple mode switch breaking contact between the spring 244 and the negative plate 246 may suffice, while a more complex means of using a peripheral spring to allow the entire contact area to be pressed inwards when the external battery is inserted, so that only then will there be connection overriding the dead internal batteries. An external power mode switch can be provided such that, when the lock is in normal operation, the conducting surfaces of external battery receiver 254 area cannot electrically connect to any active internal components. When the internal batteries are dead, and an emergency battery is in place, there needs to be a means to shunt its power inside to open the lock, and for this reason, a mode switching means can be provided.

Clip Lock Implementation

As outlined in FIG. 1*a*, a user loads a dedicated software application into their wireless device 12 (e.g. smartphone), and then is able to actuate 136 the locking mechanism 122 of their clip lock 110 remotely by means of user input 24 to the software graphical user interface (G.U.I) 14 on their phone. A Bluetooth™ wireless signal 16 from the wireless device 12 is sent to a Bluetooth™ receiver 164 on the main PCB 162 inside the clip lock 110. The wireless signal 16 will most likely be encrypted for security, and will then be decoded by the main PCB 162, which will then actuate the mechanism 122 to either lock or unlock the gate wheel 126 and its associated gate 124.

The housing 112 of clip lock 110 is a shell that uses both sides to support device elements, is enclosed by front 116 and rear 118 cover plates, and supports a contiguous stationary hook 114 which mates with a gate 124 arm which rotates around a contiguous gate wheel 126 and creates the lock. Interlocks increase the security of the clip lock 110 by preventing the hook 114 from being forced or bent away from the gate 124. A carrier (CL) 120 frame supports internal actuator 136 and mechanism 122 elements and is inserted into the front of the housing 112. (see FIGS. 6*a* & 6*b*)

As shown in FIG. 7*b*, the latched 20 state is where the pawl 148 is retracted by the energized pawl wire 138 while the catch 154 secures the pawl 148 by means of its spring 156, and because the catch wire 139 is not energized. This allows the gate wheel 126 to rotate freely so that the gate 124 may be opened when force applied, but when latched is held closed by the force of the gate spring 132. By this means, the clip lock 110 may be used as a reliably operating carabiner device when the locking mechanism is disengaged as shown.

As shown in FIG. 7*c*, the locked 22 state is where the pawl 148 is left free to rotate by de-energizing the pawl wire 138, and energizing the catch wire 139 so that the catch 154 releases the pawl 148 so that its spring 152 pivots the pawl 148 into a notch in the gate wheel 126, which secures the gate 124 in the locked position. To move from locked 22 to latched 20 state, the reverse steps are taken, namely, the catch wire 139 is released, the pawl wire 138 is energized, causing the pawl 148 to retract, and as it clears the catch 154, the catch spring 156 forces it downwards to prevent the pawl 148 from stopping the gate wheel 126 from rotating freely.

The rear of housing 112 contains some of the electronics 160, namely the capacitor(s) 172 and related switch board 166, while the main PCB 162 with its receiver 164 and the battery 168 overlay actuator and mechanism elements in front of the housing 112. (see FIGS. 6*a* & 6*b*) As with the pivot lock 26, similar circuitry is used to receive a wireless signal, decode, process, and send a control signal to the actuator 136. In this case the actuator 136 is comprised of lengths of memory wire, or flexinol, which has the property of contracting in length when electrically energized. Pulleys are used to guide the memory wires, reduce kinks and to extend the length of the memory wire used for more consistent actuation. Capacitors 172 are used to boost the current to activate the memory wires, and their output is controlled by a command from the main PCB 162 which tells the switch board 166 to select whether the pawl wire 138 or the catch wire 139 are energized.

Some preferred materials for constructing said novel device will now be described. Other materials may be used also or in the alternative. The housings and covers are made of cast, forged, stamped or machined steel and critical structures such as the shackle, hook, and gate/gate wheel, pawl, catch and striker plate may be hardened or made from hardened steel or critical surfaces reinforced appropriately. The carriers are made from Delrin™ or acetal or other non-conductive rigid material, which insulates electrical elements from each other, especially memory wire, power sources, and PCBs. Note that kapton tape or similar methods may be used to insulate between components and to prevent unwanted conduction paths as needed. Especially note that the ring terminal crimp fastener assembly is made from mostly non-conductive materials such as acetal washers, nylon fasteners, etc., in order to electrically isolate terminations of memory wire from other components, and each other. Pulleys, plates & washers can be made from acetal, Delrin™, ceramic or nylon as necessary to provide adequate electrical isolation.

Other embodiments of the novel device will now be discussed. Further embodiments are not ruled out or similar methods leading to the same result. The Portable Lock System 10 can have the means to provide visual or auditory indication of its locking status or change of status. By this means, an LED and/or audible signal from the lock (26 or 110) will follow receipt of a wireless signal 16 from a wireless device 12 that changes the lock's status. (see PLM elements 190, 250, 252)

The Pivot Lock (PLM) 180 may also include a portable key fob that fits into the external battery receiver 254, and which may hold a spare battery which can supply external power through said receiver 254 bay. The portable fob may also house the means to open the pivot lock 180 such as a readable memory chip or a wireless module that can be interrogated by the lock or transmit a passcode to the lock or even a wired path between the fob and the Bluetooth™ of the lock. The object of the fob is use as a convenient portable backup means to open a specific or multiple locks, but it also may be delimited in that it could only be used once, and could employ a rolling passcode that needed to be reset by the parent device (i.e. original smartphone) in order to prevent repeated unauthorized access. Digitally protected lock access offers many more options for both convenient access as well as enhanced security options as shown herein.

Other advantages of using the Wireless Self-Closing Portable Lock System over other methods or devices will now be described if not already mentioned elsewhere.

An advantage to using an L-shaped shackle bar vs. the common U-shaped shackle: most loops or door hasps through which padlock shackles are inserted are vertical, requiring a user to rotate the lock to install; the L-bar inserts directly and snaps shut automatically and reliably. Note that the L-shaped shackle bar doesn't have to be shaped like an L, as long as it can latch into the housing. Other shapes can be employed for unique applications such as special reinforced conduits covering the shackle, as may be employed on shipping containers or security doors or portable equipment containers.

Advantages of a self-closing clip/pivot lock design: One handed operation to close lock vs. two handed operation with traditional padlocks.

No need for carrying or locating correct keys or having to orient lock and fit key into keyway. A keyless portable lock can be made resistant to water and other contaminants. Users with hand/finger disabilities or similar impairments will find that a lock system which can be remotely unlocked without the need for keyed operation, and which requires less strenuous pivoting or levering will be much easier to open than conventional padlocks.

In addition, the disclosed shackle/gate snaps shut with a spring, and relies on the user to open it manually, using power more efficiently than locks which use motors to open/close. The use of a solenoid or memory wire to lock is a low energy solution that provides extended and reliable operation over previous designs. Clip locks are generally thinner than pivot locks because they can use smaller actuators. This advantage provides smaller pocket size locks which enable many more versatile applications than larger, bulkier locks.

Advantages of wireless lock actuation: faster lock securement & removal of one or many locks simultaneously. Devices can be conveniently opened as a user approaches, by the user, anyone sent the passcode, or even by a facility security administrator from a distance. The ability to electronically transfer a passcode to an authorized user's wireless device 12 as they stand in front of a wireless lock barring their way is an advantage that mechanical locks and physical keys lack. An additional level of security can be created by using rolling pass-codes, and limiting the number of unsuccessful unlocking attempts, neither of which could be possible with generic mechanical locks.

In addition, a wirelessly accessible portable lock system allows one to electronically re-key a lock or locks remotely and/or designate access limits by time and/or number of uses. For example, a signal receiver or other electronic system within the lock may include a counter that counts a number of times a particular passcode or other electronic key has been used to open the lock. The lock may also comprise a data store or fixed record containing a maximum number of times that the particular electronic key may be used to open the lock. The lock may include logic circuits configured to compare the value stored by the counter to the maximum number of times that the particular electronic key may be used to open the lock and to inhibit operation of the lock by the particular electronic key if doing so would cause the value of the counter to exceed the maximum number.

By combining the power of uniquely designed physical locks with wireless access by encrypted passcodes and secure software applications, the user can remotely control the digital keys and locking systems of one or many locks, with a versatility and functionality that strictly physically-keyed locks are unable to match.

Advantages of the motor actuated pivot lock: lower power consumption and thereby a longer battery lifetime. When the batteries do expire, this pivot lock version permits the user to open their lock by shunting in power from an external battery while providing the appropriate authorization signal. (wired or wireless as explained above) Locked battery and carrier covers prevent unwanted access to the vulnerable internal components which may be used to manually release the lock.

The foregoing description of the preferred apparatus and method of fabrication and operation should be considered as illustrative only, and not limiting. Other forming techniques and other materials may be employed towards similar ends. Various changes and modifications will occur to those skilled in the art, without departing from the true scope of the invention as defined in the above disclosure, and the following illustrations.

Interpretation Of Terms

Unless the context clearly requires otherwise, throughout the description and the claims:

- "comprise", "comprising", and the like are to be construed in an inclusive sense, as opposed to an exclusive or exhaustive sense; that is to say, in the sense of "including, but not limited to";
- "connected", "coupled", or any variant thereof, means any connection or coupling, either direct or indirect, between two or more elements; the coupling or connection between the elements can be physical, logical, or a combination thereof;
- "herein", "above", "below", and words of similar import, when used to describe this specification, shall refer to this specification as a whole, and not to any particular portions of this specification;
- "or", in reference to a list of two or more items, covers all of the following interpretations of the word: any of the items in the list, all of the items in the list, and any combination of the items in the list;
- the singular forms "a", "an", and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present), depend on the specific orientation of the apparatus described and illustrated. The subject matter described herein may assume various alternative orientations. Accordingly, these directional terms are not strictly defined and should not be interpreted narrowly.

Embodiments of the invention may be implemented using specifically designed hardware, configurable hardware, programmable data processors configured by the provision of software (which may optionally comprise "firmware") capable of executing on the data processors, special purpose computers or data processors that are specifically programmed, configured, or constructed to perform one or more steps in a method as explained in detail herein and/or combinations of two or more of these. Examples of specifically designed hardware are: logic circuits, application-specific integrated circuits ("ASICs"), large scale integrated circuits ("LSIs"), very large scale integrated circuits ("VLSIs"), and the like. Examples of configurable hardware are: one or more programmable logic devices such as programmable array logic ("PALs"), programmable logic arrays ("PLAs"), and field programmable gate arrays ("FPGAs")). Examples of programmable data processors are: microprocessors, digital signal processors ("DSPs"), embedded processors, graphics processors, math co-processors, general purpose computers, server computers, cloud computers, mainframe computers, computer workstations, and the like. For example, one or more data processors in a control circuit for a device may implement methods as described herein by executing software instructions in a program memory accessible to the processor(s).

Processing may be centralized or distributed. Where processing is distributed, information including software and/or data may be kept centrally or distributed. Such information may be exchanged between different functional units by way of a communications network, such as a Local Area Network (LAN), Wide Area Network (WAN), or the Internet, wired or wireless data links, electromagnetic signals, or other data communication channel.

Software and other modules may reside on servers, workstations, personal computers, tablet computers, smart phones, PDAs, and other devices suitable for the purposes described herein. Those skilled in the relevant art will appreciate that aspects of the system can be practiced with other communications, data processing, or computer system configurations, including: Internet appliances, hand-held devices (including personal digital assistants (PDAs)), wearable computers, all manner of cellular or mobile phones, multi-processor systems, microprocessor-based or programmable consumer electronics and the like.

The invention may also be provided in the form of a program product. The program product may comprise any non-transitory medium which carries a set of computer-readable instructions which, when executed by a data processor, cause the data processor to execute a method of the invention (e.g. a method for unlocking a lock or a method for locking a lock). Program products according to the invention may be in any of a wide variety of forms. The program product may comprise, for example, non-transitory media such as magnetic data storage media including floppy diskettes, hard disk drives, optical data storage media including CD ROMs, DVDs, electronic data storage media including ROMs, flash RAM, EPROMs, hardwired or preprogrammed chips (e.g., EEPROM semiconductor chips), nanotechnology memory, or the like. The computer-readable signals on the program product may optionally be compressed or encrypted.

In some embodiments, the invention may be implemented in software. For greater clarity, "software" includes any instructions executed on a processor, and may include (but is not limited to) firmware, resident software, microcode, and the like. Both processing hardware and software may be centralized or distributed (or a combination thereof), in whole or in part, as known to those skilled in the art. For example, software and other modules may be accessible via local memory, via a network, via a browser or other application in a distributed computing context, or via other means suitable for the purposes described above.

Where a component (e.g. an arm, member, mechanism, assembly, device, circuit, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples, but should be given the broadest interpretation consistent with the description as a whole.

What is claimed is:

1. A portable lock comprising:

a lock body;

a locking arm having a first end pivotally connected to the lock body for pivotal rotation about a first axis and a free end movable relative to the lock body, the locking arm pivotally movable between a closed position wherein the free end engages a portion of the lock body and an open position wherein the free end is spaced apart from the portion of the lock body by a gap, the locking arm constrained to move relative to the lock body only by rotation about the first axis;

a bias mechanism arranged to bias the locking arm toward the closed position;

an electrically-controlled locking mechanism having: a locked configuration wherein, with the locking arm in the closed position, the locking mechanism locks the locking arm in the closed position; and an unlocked configuration wherein the locking arm is pivotally movable from the closed position to the open position;

a signal receiver connected to control the locking mechanism to switch from the locked configuration to the unlocked configuration in response to receiving an unlock signal; and a gate wheel fixed to pivot with the locking arm, the gate wheel having a gate wheel notch;

wherein the locking arm and lock body lie in a common plane when the locking arm is in the closed position and wherein the locking arm and the body remain in the common plane as the locking arm moves from the closed position into the open position and the electrically-controlled locking mechanism comprises:

a pawl pivotally movable between an engaged position wherein the pawl is positioned to be received in the gate wheel notch and a disengaged position, the pawl biased toward the engaged position; and a pawl wire coupled to move the pawl between the engaged position and the disengaged position.

2. A portable lock according to claim 1, wherein the portable lock is configured with an access limit that limits a number of times the unlock signal may be used to activate the locking mechanism.

3. A portable lock according to claim 1, in combination with a portable control comprising a transmitter configured to transmit the unlock signal to the signal receiver.

4. A portable lock according to claim 1, comprising a catch biased into contact with the pawl, the catch located to stop the pawl from moving into the engaged position; the catch movable by applying tension to a catch wire into a position such that the catch does not block the pawl from moving into its engaged position.

5. A portable lock according to claim 4, wherein the pawl wire and the catch wire are made of memory wire of a type that contracts when energized.

6. A portable lock according to claim 5, wherein:

a first end of the pawl wire is anchored to the lock body and a second end of the pawl wire is coupled to the pawl such that when the pawl wire is energized and contracts, the pawl wire pulls the pawl to pivot into the disengaged position;

a first end of the catch wire is anchored to the lock body and a second end of the catch wire is coupled to the catch such that when the catch wire is energized and contracts, the catch wire pulls the catch out of contact with the pawl;

if the catch wire is energized and the pawl wire is de-energized, the pawl is free to move into the engaged position to secure the locking arm in the closed position; and if the pawl wire is energized and the catch wire is de-energized, the pawl is secured in the disengaged position by the catch, allowing the locking arm to pivot freely.

7. A portable lock according to claim 1, in combination with a portable programmable device comprising a processor, a wireless transmitter and software configured to cause the wireless transmitter to send a wireless unlock signal to the signal receiver.

8. A portable lock according to claim 7 wherein the portable device comprises a remote control, a mobile phone, or a portable computer.

9. A portable lock according to claim 8, wherein the software is configured to require one or more of biometric and audio input before causing the wireless transmitter to transmit the wireless unlock signal.

10. A lock according to claim 1 wherein the pawl wire is made of memory wire of a type that contracts when energized.

11. A portable lock according to claim 10, wherein:

a first end of the pawl wire is anchored to the lock body and a second end of the pawl wire is coupled to the pawl such that when the pawl wire is energized and contracts, the pawl wire pulls the pawl to pivot into the disengaged position.

12. A portable lock comprising:

a lock body;

a locking arm having a first end pivotally connected to the lock body for pivotal rotation about a first axis and a free end movable relative to the lock body, the locking arm pivotally movable between a closed position wherein the free end engages a portion of the lock body and an open position wherein the free end is spaced apart from the portion of the lock body by a gap, the locking arm constrained to move relative to the lock body only by rotation about the first axis;

a bias mechanism arranged to bias the locking arm toward the closed position;

an electrically-controlled locking mechanism having: a locked configuration wherein, with the locking arm in the closed position, the locking mechanism locks the locking arm in the closed position; and an unlocked configuration wherein the locking arm is pivotally movable from the closed position to the open position;

a signal receiver connected to control the locking mechanism to switch from the locked configuration to the unlocked configuration in response to receiving an unlock signal; and a gate wheel fixed to pivot with the locking arm, the gate wheel having a gate wheel notch;

wherein the electrically-controlled locking mechanism comprises:

a pawl pivotally movable between an engaged position wherein the pawl is positioned to be received in the gate wheel notch and a disengaged position, the pawl biased toward the engaged position; and a pawl wire coupled to the pawl.

13. A lock according to claim 12 wherein the pawl wire is made of memory wire of a type that contracts when energized.

14. A portable lock according to claim 13, wherein:

a first end of the pawl wire is anchored to the lock body and a second end of the pawl wire is coupled to the pawl such that when the pawl wire is energized and contracts, the pawl wire pulls the pawl to pivot into the disengaged position.

15. A portable lock according to claim 12 comprising a catch biased into contact with the pawl, the catch located to stop the pawl from moving into the engaged position; the catch movable by applying tension to a catch wire into a position such that the catch does not block the pawl from moving into its engaged position.

* * * * *